US007267157B2

(12) United States Patent
Ohtaki et al.

(10) Patent No.: US 7,267,157 B2
(45) Date of Patent: Sep. 11, 2007

(54) MOLDING AND TRANSPORTING APPARATUS AND METHOD THEREFOR

(75) Inventors: Katsuharu Ohtaki, Kumamoto (JP); Shigeru Kiyota, Kumamoto-ken (JP)

(73) Assignee: Kabushiki Kaisha Koyo, Kumamoto-Ken (JP)

( * ) Notice: Subject to any disclaimer, the term of this patent is extended or adjusted under 35 U.S.C. 154(b) by 280 days.

(21) Appl. No.: 10/850,191

(22) Filed: May 20, 2004

(65) Prior Publication Data

US 2004/0238145 A1 Dec. 2, 2004

(30) Foreign Application Priority Data

Jun. 2, 2003 (JP) ..... 2003-156106

(51) Int. Cl.
*B22C 17/00* (2006.01)
*B22C 15/00* (2006.01)

(52) U.S. Cl. ..... 164/180; 164/182; 164/187; 164/207

(58) Field of Classification Search ..... 164/24, 164/40, 182, 187, 207, 180
See application file for complete search history.

(56) References Cited

U.S. PATENT DOCUMENTS 4,721,148 A * 1/1988 Knudsen ..... 164/187

FOREIGN PATENT DOCUMENTS

JP 07060406 * 3/1995

OTHER PUBLICATIONS

Koyo, "," Automatic Flaskless Molding Machine, Koyo, LTD. (JAPAN), p. 12.

* cited by examiner

*Primary Examiner*—Kevin Kerns
*Assistant Examiner*—I.-H. Lin
(74) *Attorney, Agent, or Firm*—Andrus, Sceales, Starke & Sawall, LLP

(57) ABSTRACT

The molding and transporting apparatus comprises a molding section for vertically blowing sand from above between a front die and a rear die that have vertically formed pattern faces, and thereafter, driving the front and rear dies and compacting the sand to produce a mold M, and for extruding the mold horizontally, a dividing mechanism for, before the sand is blown, vertically dividing the mold into front and rear portions, as needed, at the center of a molding space, a pouring port formation mechanism for forming a pouring port in the mold; and a form converter for selectively rendering an active operation for changing the form of the mold that is extruded from the molding section from the vertically split form to the horizontally split form, and a non-active operation for transporting the extruded mold to a pouring line, without changing the form of the mold. According to the molding and transporting apparatus and the method, performance of the molding and transportation processes by the vertical and the horizontal molding functions, reductions in size and manufacturing costs, and satisfactory compaction are ensured when either the active or the inactive mode is selected.

8 Claims, 17 Drawing Sheets

(A)

(B)

MOLDING AND TRANSPORTING APPARATUS AND METHOD THEREFOR

BACKGROUND OF THE INVENTION

1. Field of the Invention

The present invention relates to a molding and transporting apparatus, and a method therefor, for using molding sand to form a mold and for transporting the mold to a pouring step.

2. Related Arts

A well-known molding machine for producing a mold for casting blows sand into and fills a molding space between two dies, an upper and a lower or a front and a rear, in which a pattern having a desired shape is formed, while a compression plate tamps and compacts the sand. The completed casting mold is then relocated for a pouring step, and molten metal is poured into the cavity formed in the mold.

An example conventional molding machine is a horizontal molding machine wherein upper and lower dies, in the horizontal faces whereof complimentary patterns are formed, are supported by upper and lower shutterings arranged to provide an intervening gap, and whereby upper and lower molds are formed, by the main bodies of the upper and lower dies, that subsequently are aligned vertically and laminated.

Another type of conventional molding machine forms molds using shuttering supported front and rear dies wherefor complimentary recessed portions, i.e., comprising metal pouring patterns, are formed in the vertical faces, and ejects the obtained molds sequentially onto a flat plane where adjacent molds are closely aligned to define pouring cavities having the shape of a product.

The horizontal molding machine is superior in that when a horizontal mold requiring a core is manufactured, the core can be stably positioned and supported in the mold. Thus, with this machine, a simple core setting operation and a satisfactory precision product can be expected.

Since the horizontal molding machine is vertically divided by a match plate, which includes a model pattern portion, inserted into the middle of the molding space, the air-jet propulsion of molding sand must be performed from both sides of the main bodies of the dies. Therefore, because of the weight of sand, a sand tank is located above the molding section, and supply shooters, located at both sides of the main bodies of the dies, blow the sand horizontally. With this configuration, however, the size of the machine tends to be increased, as is the cost of manufacturing the shooter section, and the time required for the sand propulsion cycle is extended.

Furthermore, for the horizontal molding machine, the pattern is transferred by using the model that is formed in the match plate located in the middle of the molding space. In this case, when sand at both sides is compacted by the compression plates, and displacement of the sand is restrained merely by the unmoving flat face of the plate against which the mold is formed, an inferior mold is produced.

However, when a vertical molding machine is designed so that pattern plates bearing model patterns are located on the pressing face sides of the front and rear dies corresponding to the side faces of a mold, and for molding, the pattern plates are used to apply compression, sand closely attached to the model pattern is displaced and a satisfactory mold formation can be obtained.

According to this vertical molding machine, the pattern plates are arranged on both sides, and a pouring port can also be formed by using the pattern faces. Therefore, with a simple structure whereby sand from a sand tank located above is blown vertically, sand filling can be completed within a short period of time.

On the other hand, for the vertical molding machine, the sand mold is transported to the pouring step with the two vertically split molds closely aligned. Therefore, for a product for which a core is required, supporting the core in the mold becomes a problem, and formation of a mold may be difficult. Further, the core insertion operation and product precision may be adversely affected.

<Prior Arts>

As an conventional example, a flaskless molding machine has been proposed in Japanese Patent Laid-Open Publication No. Sho 59-220249. According to the flaskless molding machine shown in FIGS. 1 and 2 in this publication, right and left or upper and lower shutterings, which are supported by a guide shaft that rotates at a rotary shaft 4, are rotated between a molding station and a shuttering removal station, and a core insertion operation can be easily performed by rotating inferior shuttering receiving frames 21 and 22, which are attached to a rotation column 19, and a match plate receiving frame 23.

First, sand is vertically and linearly blown into the molding space and compacted. Thereafter, at the rotary shaft 4, the shutterings are rotated 90 degrees and moved to the shuttering removal station and a core is inserted. Thereafter, a shuttering removal cylinder synchronously descends to remove the upper and lower molds from the shutterings and to transport the obtained molds. Thus, the flaskless molding machine disclosed in this publication has the same advantages as are provided by both the conventional vertical molding machine and the horizontal molding machine.

However, for a flaskless molding machine, the installation of a molding station is required that covers the rotational range of the guide shaft, the diameter of which includes an opening margin for the shutters, and a shuttering removal and core insertion station is required that moves vertically, at a location within the rotational range wherein the guide shaft is arranged horizontally, and that performs the shuttering removal and the core insertion. As a result, the actual size of this molding machine is greatly increased, and not only is a large amount of vertical and horizontal installation space required, but also, manufacturing costs are increased.

Further, since the shutterings are slidably supported by the guide shaft, which pivots at the rotary shaft 4, a larger load is imposed on the guide shaft or the bearing of the rotary shaft 4. And therefore, the replacement cycle for these parts is shortened, increasing both maintenance costs and the power load.

Furthermore, the molding machine disclosed in Japanese Patent Laid-Open Publication No. Sho 59-220249 has the single function of serving as a horizontal molding machine wherein a match plate 11 is located in the middle of the molding space and whereby molds are merely vertically laminated and transported to the pouring step. Thus, since the molding machine is designed so that molding sand is compacted from both sides by flat plates, and therefore a portion of sand to which a smaller pressing force is applied is pressed against the model pattern face, a definite problem exists in that an inferior mold formation process is performed and the product precision is deteriorated.

SUMMARY OF THE INVENTION

<Objectives of the Invention>

To resolve these conventional shortcomings, it is a first objective of the present invention to provide a small, low cost multi-functional molding and transporting apparatus, for which an easy core setting operation, core support reliability, improved product precision, reduced molding time and satisfactory mold formation are ensured, that can be used alone, either as a vertical or horizontal molding machine, and to also provide an operating method for the apparatus.

It is a second objective of the present invention to provide a small, low cost mold transporting apparatus, for which an easy core setting operation, core support reliability, improved product precision, reduced molding time and satisfactory mold formation are ensured, that not only provides substantially all the advantages of a vertical molding machine, but can also transport to a pouring line molds that have been horizontally laminated.

<Disclosure of the Invention>

The present invention will be disclosed while referring to the accompanying drawings. To achieve the above objectives, a molding and transporting apparatus 10 according to one aspect of the present invention comprises:

a molding section 14 for using shutterings 48 and 50 to define a molding space S between a front die 22 and a rear die 24, horizontally arranged opposite each other, that have vertically formed pattern faces, for, after sand has been vertically blown into the molding space S from above, driving the front and rear dies 22 and 24 and compacting the sand to produce a mold M, and for extruding the mold M horizontally;

a dividing mechanism 18 for, before the sand is blown into the molding space S, vertically dividing the mold M into front and rear portions, as needed, at the center of the molding space S;

a pouring port formation mechanism 20 for using the faces of the mold segments obtained by vertical division to form a pouring port in the mold M; and a form converter 16 for selectively rendering an active operation for vertically laminating only the mold segments of the mold M that are extruded from the molding section 14 and changing the form of the mold M, and a non-active operation for transporting, to a pouring line, the mold M extruded by the molding section 14, without changing the form of the mold M.

When the mold M is rearranged by changing the form, the core can be reliably positioned and supported, and satisfactory product precision can be obtained. When the mold is to be transported to the pouring line with the mold segments M vertically laminated, the dividing mechanism 18 and the pouring port formation mechanism 20 are not activated, so that only one mold M is produced in the molding space S and the pattern is formed in both its front and rear side faces. Sequentially, the obtained molds M are transported to the pouring line, and their side faces are aligned, so that a target product pouring space can be obtained.

As is described above, the molding and transporting apparatus of the present invention can selectively perform a vertical molding function and a horizontal molding function. An arbitrary form conversion method may also be selected. For example, two molds can be grasped at the same time, and be combined with another mold by standing rotation (clockwise), inverted standing rotation (counterclockwise) or horizontal rotation of 90 or 180 degrees.

Instead of rotating and performing form conversion of molds that have been extruded, a separate actuator may hold and match the molds, and the set of molds obtained may be transported to the pouring line as correctly matched molds.

For form conversion, a bare mold extruded by the molding section must be grasped and aligned with another mold. The matching of the bare molds may be handled together with backing plates, or a guide path may be formed and molds continuously pushed forward to change their locations. Preferably, a mold is clamped by a cylinder mechanism, or a gripping mechanism like a pantograph, or a spring mechanism.

The form converter 16 includes:

a rotation device 114 for rotating a front mold Mp and a rear mold Mq that have been extruded, and for vertically laminating the two molds Mp and Mq to obtain a horizontally split form; and a matching device 115 for aligning a previously transported mold Mr and one of the molds, the mold Mq, to assemble a horizontally split form, and for transporting the assembly comprising the molds Mr and Mq to a pouring line L.

In this case, molds that have been rotated and gripped are positioned at a higher level and other molds are raised and aligned with them. This process results in no wasted movements, and a driving mechanism, such as a driving actuator, can be provided. The other molds can also be rotated counterclockwise and aligned with molds that are lowered. Further, the molds may be horizontally rotated, and an appropriate halting position can be designated.

The dividing mechanism 18 includes a division plate 86 to be inserted into and retracted from the molding space S that is to be vertically divided. The pouring port formation mechanism 20 includes a pouring rod 88 that projects outward horizontally from the division plate 86.

When the horizontal molding function is selected, the division plate that is required to vertically divide the molding space can also be employed to form a pouring port. As a result, multiple use of the member and simplification of the structure contribute to a reduction in cost and simplification of the operation.

Furthermore, in the active mode of the form converter 16, the outer faces of the mold M are directly clamped to change a vertically split form of the mold M into a horizontally split form.

According to another aspect of the invention, a molding and transporting apparatus 10 comprises:

a molding section 14 for using shutterings 48 and 50 to define a molding space S between a front die 22 and a rear die 24, horizontally arranged opposite each other, that have vertically formed pattern faces, for, after sand has been vertically blown into the molding space S from above, driving the front and rear dies 22 and 24 and compacting the sand to produce a mold M, and for extruding the mold M horizontally;

a match plate insertion/removal mechanism 132 for, before sand is blown into the molding space S, inserting a match plate, in which a pattern face is vertically formed, into the middle point in the molding space S, as needed;

a pouring port formation mechanism 134 that is driven, as needed, to form a pouring port in the mold M; and a form converter 16 for selectively rendering an active operation for vertically laminating only the mold segments of the mold M that are obtained by the match plate and are extruded from the molding section 14 and for changing the form of the mold M, and an on-active operation for transporting, to a pouring line, the mold M extruded by the molding section 14, without changing the form of the mold M.

The match plate, in which a pattern is formed in both faces and which originally is inserted in the horizontal direction, is positioned upright in the molding space to obtain a mold having a vertically split form. Further, the pouring port formation mechanism is provided and combined with the form converter to obtain a multi-function molding machine that incorporates both the vertical molding function and the horizontal molding function. For the molding and transporting apparatus that uses the match plate, since a correct pouring space is already defined between the aligned mold faces, a device for aligning molds after the form conversion is not required, and the two upper and lower molds that are vertically laminated must be simply accepted and lowered. Thus, the control process and the structure can be simplified.

Furthermore, the form converter 16 may include:

a rotation device 114, for so rotating a front mode Mp and a rear mold Mq that the rear mold Mp and the front mold Mq can be vertically laminated in the named order; and a driving mechanism 128, for transporting to a pouring line the assembly comprising the rear and front molds Mq and Mp that are positioned in the named order by the rotation device. At this time, the external faces of the mold must be gripped directly, so that the form converter 16 in the active state can convert the vertical split form of the mold into the horizontal split form.

According to an additional aspect of the invention, a molding and transporting apparatus comprises:

a molding section 14 for using shutterings 48 and 50 to define a molding space S between a front die 22 and a rear die 24, horizontally arranged opposite each other, that have vertically formed pattern faces, for, after sand has been vertically blown into the molding space S from above, driving the front and rear dies 22 and 24 and compacting the sand to produce a mold M, and for extruding the mold M horizontally;

a dividing mechanism 18, which is to be activated before sand is blown into the molding space S and which, in the molding space S, vertically divides the mold M at an intermediate position to obtain front and rear mold segments;

a pouring port formation mechanism 20, for forming a pouring port in the mold M; and a form converter 16, for vertically laminating only the front and rear mold segments extruded by the molding section 14 to provide a mold assembly having a horizontally split form and for transporting the mold assembly to a pouring line.

That is, according to the invention, the dividing mechanism, the pouring port formation mechanism and the form converter are not selectively designated and activated only for the horizontal molding function, but are consistently employed as special horizontal molding mechanisms and for molding. In this case, the vertical propulsion of sand, the simplification and stability of the core insertion operation, the reduction in time and the reliability of the core support are ensured. Further, when a pattern plate in which a pattern is formed on both sides is employed, satisfactory mold formation is obtained.

Furthermore, when the match plate is employed, the simplification of the structure, the reduction in the power load, satisfactory maintenance and the reduction in the size of the entire machine can also be achieved, and more space can be saved.

According to an additional aspect of the invention, provided is a molding and transporting method, for producing a mold and transporting the mold to a pouring step by employing a vertical molding method that includes the step of using shutterings 48 and 50 to define a molding space S between a front die 22 and a rear die 24, horizontally arranged opposite each other, that have vertically formed pattern faces, and vertically blowing sand into the molding space S from above, and the step of, after the sand has been filled, driving the front and rear dies 22 and 24 and compacting the sand to produce a mold M, whereby, after the mold M has been extruded from a molding section, rotating and aligning the mold M with another sand mold having a corresponding pattern, and transporting the mold M and the other sand mold to a pouring step.

According to a further aspect of the invention, a molding and transporting method, for producing a mold and transporting the mold to a pouring step by employing a vertical molding method that includes the step of using shutterings 48 and 50 to define a molding space S between a front die 22 and a rear die 24, horizontally arranged opposite each other, that have vertically formed pattern faces, and vertically blowing sand into the molding space S from above, and the step of, after the sand has been filled, driving the front and rear dies 22 and 24 and compacting the sand to produce a mold M, comprises:

a step of horizontally extruding a mold obtained by compaction, and transporting the mold directly to a pouring step;

a first step that includes the steps of before sand is blown into the molding space, vertically dividing the mold at the intermediate position in the molding space to obtain a vertically split mold, forming a pouring port in the mold, and combining two horizontally extruded molds with a previously extruded mold, and transporting the molds to the pouring step; and a second step that includes the steps of after the mold has been produced using the vertical molding method, horizontally extruding the mold without performing the first step, and transporting the mold directly to the pouring step, whereby either the first or the second step is selected to produce and transport the mold.

At this time, at the first step of combining the two molds that have been extruded horizontally and the previously extruded mold, the two molds are gripped and rotated by a rotation arm mechanism to obtain a vertically laminated arrangement. The first step may further include a step of, before the alignment of the previously extruded mold with one of the two molds, setting a core while an arm of the rotation arm mechanism, which has been rotated horizontally from an alignment section, is retracted at a position for accepting the two molds that have been extruded.

DETAILED DESCRIPTION OF THE PREFERRED EMBODIMENTS

Figure 1:
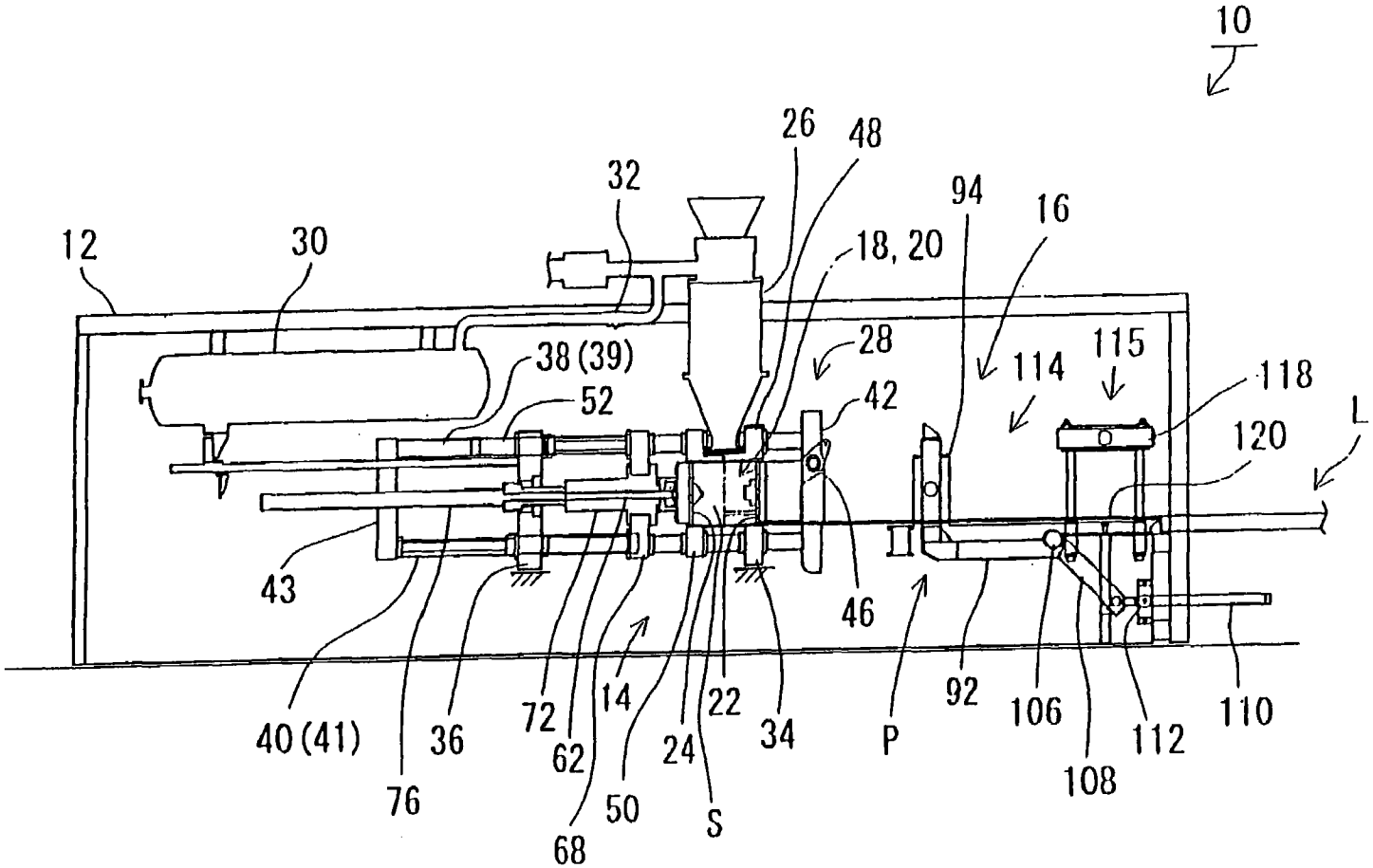
FIG. 1 is a schematic side-view of an overall molding and transporting apparatus according to a first embodiment of the present invention.

The preferred embodiments of the present invention will now be described while referring to the accompanying drawings. FIGS. 1 to 8 are diagrams showing a molding and transporting apparatus used for casting according to a first embodiment of the present invention.

The molding and transporting apparatus for the invention is a small apparatus having a simple structure that performs molding and transporting while providing the advantages available with both a vertical molding machine and a horizontal molding machine. Especially according to the molding and transporting apparatus in the first embodiment, since a vertical molding mode and a horizontal molding mode can be selectively designated, only a single apparatus is required to provide the vertical and the horizontal molding functions.

In FIGS. 1 to 8, a molding and transporting apparatus 10 is supported by a frame assembly 12 having a parallelepiped shape. The molding and transporting apparatus 10 primarily comprises a molding section 14, a form converter 16, a dividing mechanism 18, attached to the molding section 14, and a pouring port formation mechanism 20. The molding section 14 is molding means for filling with molding sand a pouring space between patterned front and rear dies (a model), with which the pouring space for a casting product is defined, and for compacting the molding sand to produce a mold M.

Specifically, in this embodiment, a molding space is defined by shutterings, between the front and rear dies, that are arranged horizontally along the sides and between which the pattern faces are vertically positioned; molding sand is blown into the molding space vertically, from above, to fill the space; and thereafter, pressure is applied to the front and rear dies to produce a mold, which is subsequently extruded horizontally.

In this embodiment, as is shown in FIG. 1, the molding and transporting apparatus 10 further comprises: a sand tank 26, which serves as means for supplying molding sand; a front die 22 and a rear die 24, which are positioned, under the propulsion port of the sand tank 26, horizontally opposite each other by a guide mechanism (not shown) and are freely movable; a driving mechanism for horizontally moving the front and rear dies 22 and 24; and an opening/closing mechanism 28 for the front die 22.

Figure 2:
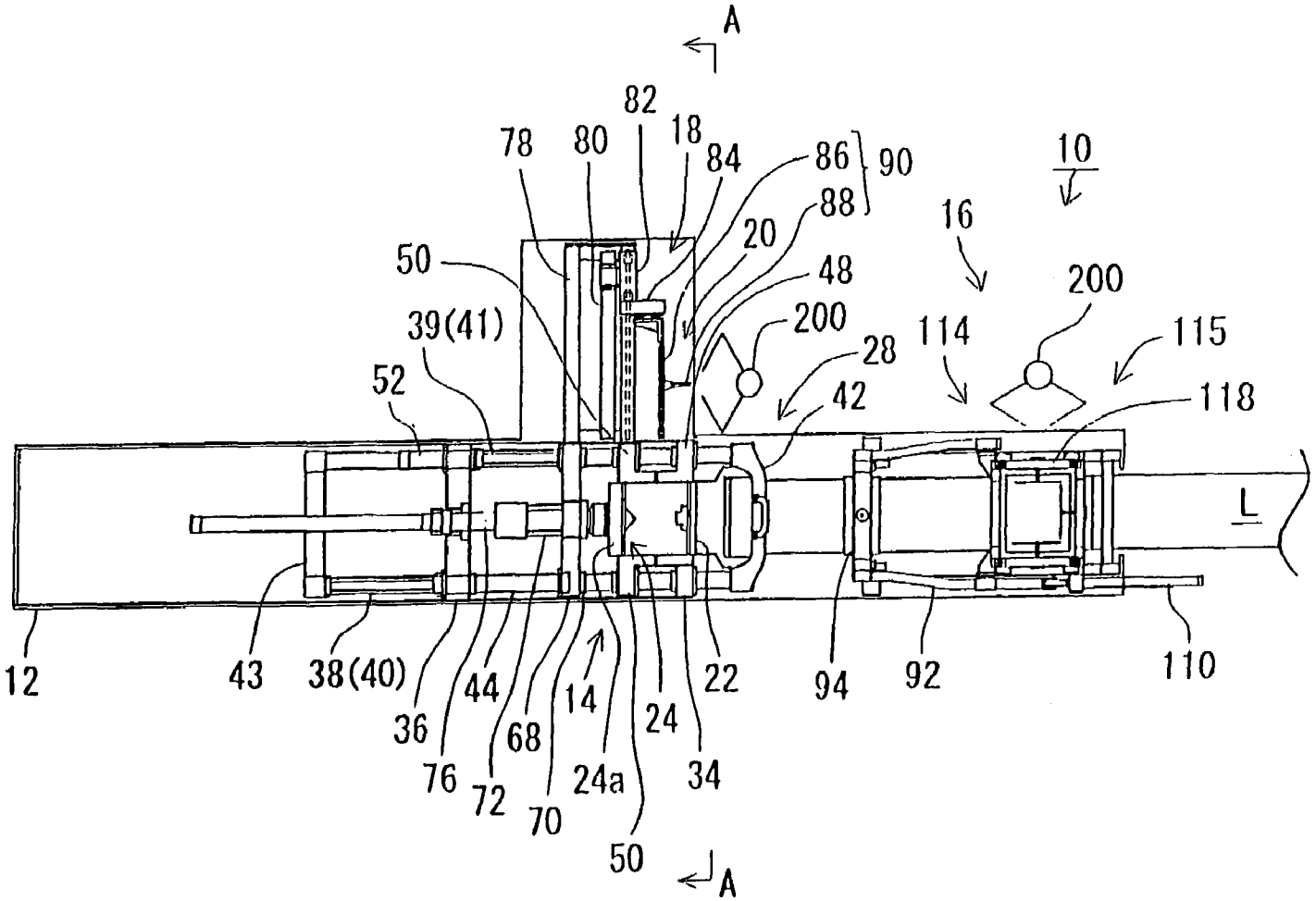
FIG. 2 is a schematic plan view of the overall molding and transporting apparatus in FIG. 1.

An air tank 30 and an air pressure valve 32 communicate with the sand tank 26, and in the vicinity under the sand tank 26, two fixed frames 34 and 36 are positioned horizontally, at an interval, and are supported by the frame assembly 12. Further, as is shown in FIG. 2, four rods (tie rods) 38, 39, 40 and 41 are provided vertically and horizontally at intervals, so that these rods 38 to 41 horizontally penetrate the fixed frames 34 and 36.

A front shuttering 42, the four rods 38, 39, 40 and 41 and a coupling frame 43 at the rear end constitute a coupling frame assembly having a parallelepiped shape. The coupling frame assembly can slide horizontally along the fixed frame 34 and 36, i.e., the coupling frame assembly in FIG. 2 can be integrally moved to the left and to the right.

More specifically, a first driving cylinder 44 is attached to the rear fixed frame 36 and drives the coupling assembly frame constituted by the rods 38 to 41. As the first driving cylinder 44 is extended or contracted, the rods 38 to 41 and the front shuttering 42, which are connected to the cylinder rod of the first driving cylinder 44, integrally reciprocate horizontally. Especially the front shuttering 42 is moved horizontally.

Figure 3:
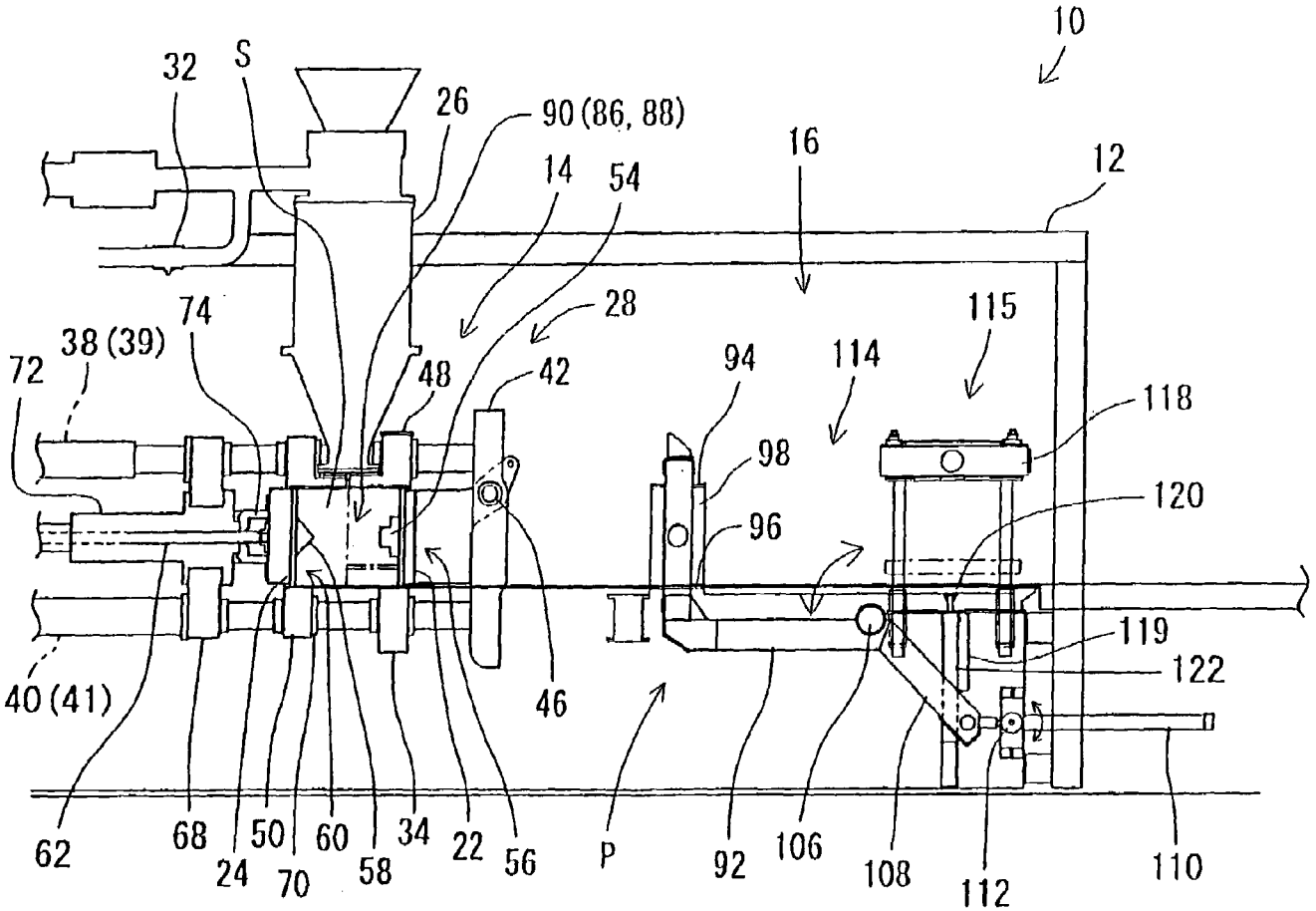
FIG. 3 is an enlarged, partially omitted side view of the molding and transporting apparatus in FIG. 1.
Figure 4:
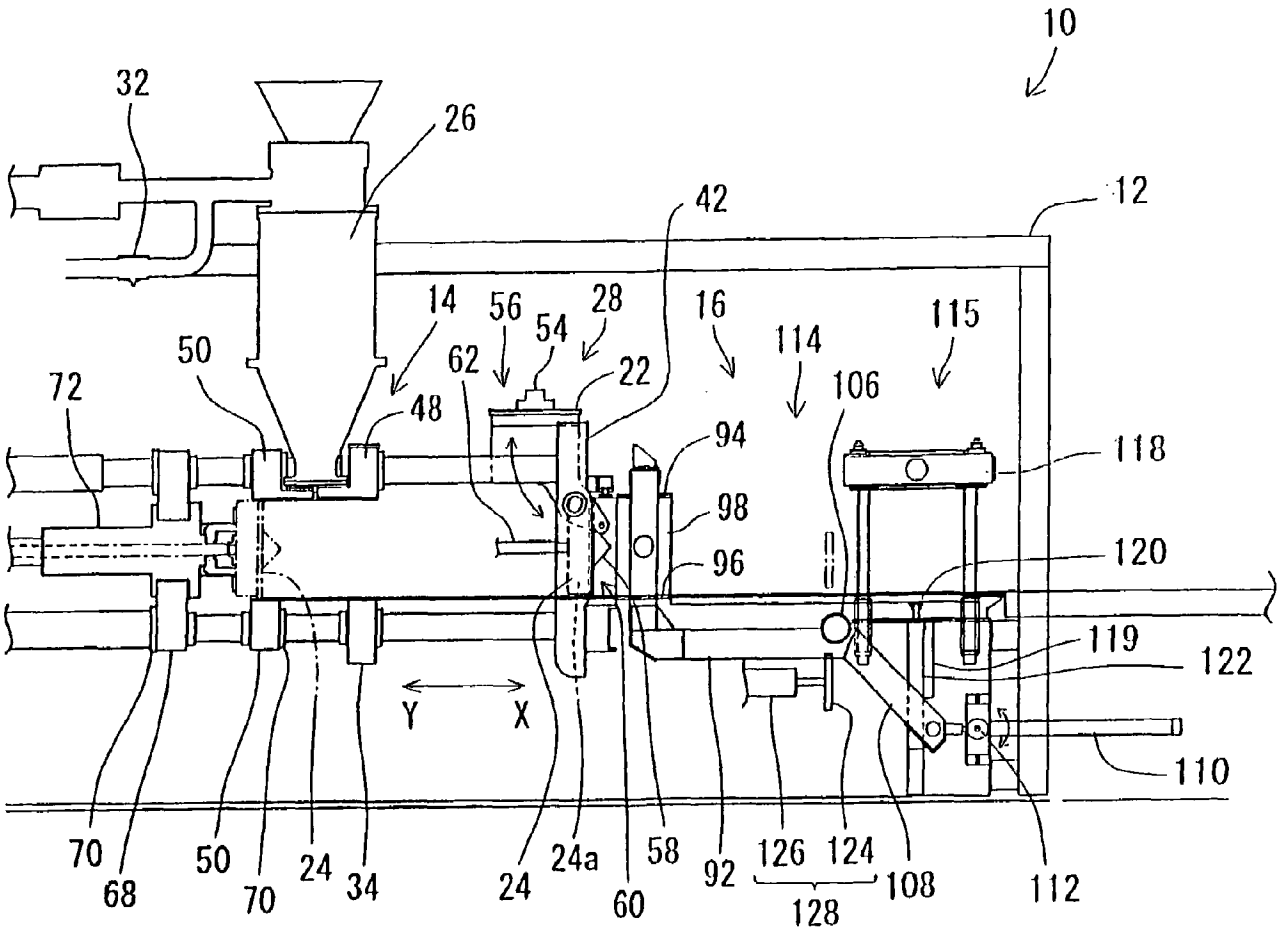
FIG. 4 is a diagram for explaining the configuration and the operation of the molding and transporting apparatus wherein, in the state shown in FIG. 3, a rear die is extruded to an acceptance position for a rotation device.

As is shown in FIGS. 1, 3 and 4, the front die 22, with which sand is compacted from forward in the molding space S and a sand mold corresponding to the pattern is obtained, is provided for the front shuttering 42, so that the front die 22 can be rotated to freely open or close the inner gap of the shuttering 42.

That is, the front shuttering 42 is a frame having a hollowed square shape, and as is shown in FIG. 3, a support shaft 46 rotates the front die 22 about 90 degrees, relative to the front shuttering 42, from the horizontal state to the upright state. During this rotation, the front die 22 opens or shields the inner gap of the front shuttering 42.

When the inner gap of the front shuttering 42 is closed, and the front shuttering 42 is positioned immediately under the propulsion port of the sand tank 26, as is shown in FIGS. 1 and 3, a closed molding shape S is defined by a rear die, which will be described later, and shutterings. After the molding space S is filled with the molding sand, the rod of the first driving cylinder 44 is extended and drives the front shuttering 42 in direction Y to compact the sand in the molding space S. The first driving cylinder 44 also functions as a positioning means for the front die 22.

Immediately below the sand propulsion port of the sand tank 26, front and rear shutterings 48 and 50 having parallelepiped shapes are located opposite each other. In this embodiment, the front shuttering 48 is securely fixed to the front fixed frame 34, while the rear shuttering 50 is slidably supported by the rods 38 to 41 and is moved forward and backward by a second driving cylinder 52, which moves the rods 38 to 41 longitudinally.

The shutterings 48 and 50 slidably support the front die 22 or the rear die 24 in the inner parallelepiped space. As is shown in FIGS. 1 and 3, while the shutterings 48 and 50 are closely aligned, the front die 22 and the rear die 24 that they support can be freely slid horizontally.

Further, when the shutterings 48 and 50 are closely aligned, and the front die 22 and the rear die 24 are located opposite, at a predetermined distance from, each other, immediately beneath the sand tank 26, a closed space between the front and rear dies 22 and 24 is defined as a molding space S.

The front die 22, positioned with its pattern face upright between the parallelepiped shutterings 48 and 50, is slidable horizontally. For the front die 22, for example, a front pattern plate 56 to which a convex model 54 is fixed is vertically arranged, and to form a sand mold, the front die 22 is moved horizontally within the shuttering 48 by a hydraulic driving force exerted by a cylinder, for example.

After the molding has been completed, as is shown in FIG. 4, the front die 22 is separated from the mold M and, together with the front frame 42, is moved in direction X to a predetermined position whereat it is rotated about 90 degrees, forming a passage along which only the obtained mold M is extruded.

Whereas, as is shown in FIG. 4, in the shuttering 50 the rear die 24 is located opposite, at an interval from, the front die 22 and is horizontally slidable, the rear die 24 includes a rear pattern plate 60 to which a conical-head model 58 is fixed, and to which the distal end of an extrusion rod 62 is fixed, substantially in the center of the rear face of the pattern plate 60. The extrusion rod 62 moves the mold M to an acceptance position P for a rotation frame 94 shown in FIG. 3.

As is shown in FIGS. 1, 3 and 4, the molding space S is a closed space that is defined by the shutterings 48 and 50 and the faces of the pattern plates 56 and 60 on which the respective models 54 and 58 are formed. To fill the molding space S, molding sand from the sand tank 26 is blown into the molding space S.

In FIGS. 1, 2 and 3, a moveable frame 68 is coupled with the rear shuttering 50 at a position midway between the front and rear fixed frames 34 and 36, and is slidably fitted over the tie rods 38 to 41 by using bushes 70. In this manner, the movable frame 68 and the rear shuttering 50 can be integrally moved.

A compression cylinder 72 is attached to the center of the movable frame 68, and is moved as the rear shuttering 50 and the movable frame 68 are integrally shifted horizontally. A pressing cylinder 74 is provided at the distal end of the compression cylinder 72, so that the extrusion rod 62 passes through the center of the pressing cylinder 74.

One end face of the pressing cylinder 74 is fixed to the distal end of the compression cylinder 72, while the other end face is freely brought into contact with, or is separated from, a back plate 24*a*, which is the main body of the rear die 24.

Further, an extrusion cylinder 76, including a cylinder having a small diameter, is arranged in the center of the rear fixed frame 36 so that it passes through the center of the compression cylinder 72. The cylinder rod of the extrusion cylinder 76 serves as the extrusion rod 62, and its distal end is fixed to the rear die 24.

The extrusion cylinder 76 and the compression cylinder 72 constitute a two-step cylinder, with the extrusion rod 62, which passes through the center, being used to separately exert a driving force. As the compression cylinder 72 is contracted or extended, the rear die 24 is driven forward by the compression force, and the mold M that is finally obtained is extruded by the extrusion cylinder 76, toward the form converter 16, from the center space of the front frame 42, which is rotated upward and opened.

Guidance rods used for the horizontal movement of the shutterings and the front and rear dies may be provided. However, to simplify the explanation, in this embodiment these guidance rods are not shown.

As is described above, in the molding section 14, the front die 22 and the rear die 24, on which the pattern faces 54 and 58 are vertically arranged, are located on the right and left sides, and the molding space S between the front and rear dies 22 and 24 is defined by the shutterings 48 and 50. Then, sand is blown vertically, from above, into the molding space S, and the mold M produced by using the front and rear dies 22 and 24 to compact the sand is extruded horizontally along the compacted plane face for the mold M.

Figure 5:
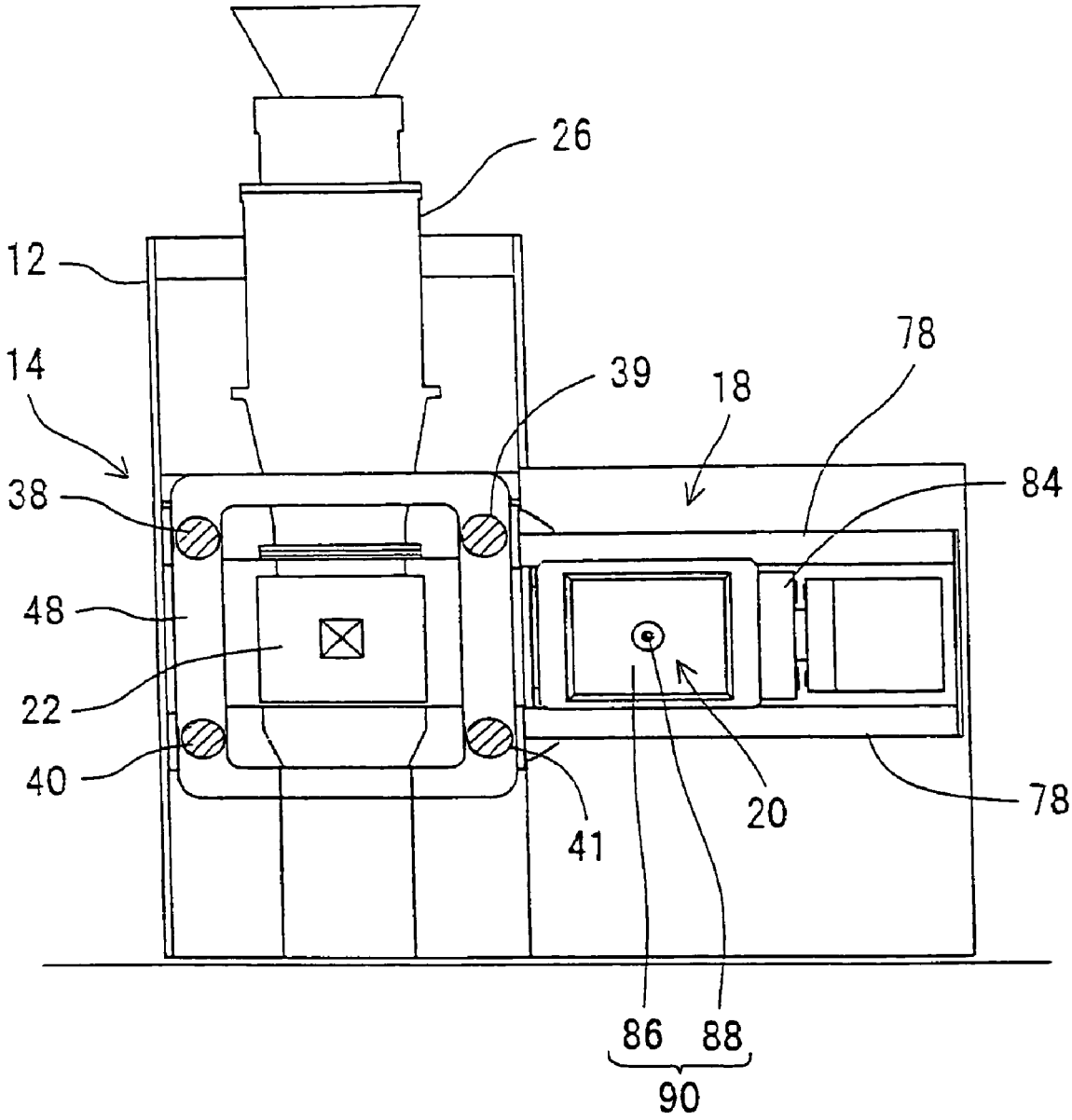
FIG. 5 is a cross-sectional view taken along a line A-A in FIG. 2.

For this embodiment, the dividing mechanism 18 and the pouring port formation mechanism 20 are located near the molding section 14. In FIGS. 2, 3 and 5, before sand is blown into the molding space S, at the middle position in the molding space S, the dividing mechanism 18 is used, as needed, to divide the mold M into front and rear portions. In this embodiment, when the molding and transporting apparatus functions as a horizontal molding machine, the active mode is selected for the dividing mechanism 18.

The dividing mechanism 18 includes a division plate 86 that is freely inserted into or retracted from the molding space S to vertically divide the molding space S. In FIGS. 2, 3 and 5, a frame 78 having an inverted C shape is fixed near the molding section 14 so as to be connected perpendicularly to the longitudinal side of the frame assembly 12. A third driving cylinder 80, a guide member 82, and a plate holder 84 are freely moved forward to or retracted from the molding space S in the direction perpendicular to the longitudinal direction of the frame assembly 12. At this time, the third driving cylinder 80 is coupled with the frame 78, and the plate holder 84 is driven by the third drive cylinder 80 and is moved linearly along the guidance member 82.

In this embodiment, a compound functional member 90 is fixed to the plate holder 84. The compound functional member 90 includes: the division plate 86, shown in FIG. 5, that has a square, flat face; and a horizontal pouring port rod 88 that is fixed, at a predetermined position, to the dividing plate 86 and extends outward, in the direction of the front die 22.

For this embodiment, the division plate 86 constitutes the essential portion of the dividing mechanism 18, and since it has a face that is larger than the pattern faces 54 and 58 of the front and rear dies 22 and 24, the mold M can be vertically divided into front and rear portions. Thus, when the division plate 86 is inserted into the middle portion of the molding space S, the division of the mold M is ensured.

Further, the pouring port rod 88 constitutes the essential portion of the pouring port formation mechanism 20. As will be described later, the horizontal aspect of the pouring port rod 88 is changed to the vertical when the mold M is rotated, for example, 90 degrees, i.e., when the position of the mold M is changed from 180 degrees to 90 degrees, and the port for the pouring of molten metal is relocated so it opens at the top of the rotated mold M.

In this embodiment, the pouring port rod 88, which originally extends in direction X but is upright after the mold M has been rotated, and the division plate 86 are integrally formed and serve as the compound functional member 90.

In this embodiment, as is described above, either the active mode or the inactive mode can be selected for the dividing mechanism 18 and the pouring port formation mechanism 20 before sand is supplied. For example, when the horizontal molding machine function is selected, the mechanisms 18 and 20 are activated, but when the vertical molding machine function is selected, they are not.

In FIGS. 1, 3, 4 and 7, the form converter 16 rearranges the molds M produced and extruded by the molding section 14 and changes the form from the vertically split state to the horizontally split state. Especially in this embodiment, as well as for the dividing mechanism 18 and the pouring port formation mechanism 20, either the active mode or the inactive mode is selected for the form converter 16, which in this embodiment includes a rotation device 114 and a mold alignment device 115.

Figure 8:
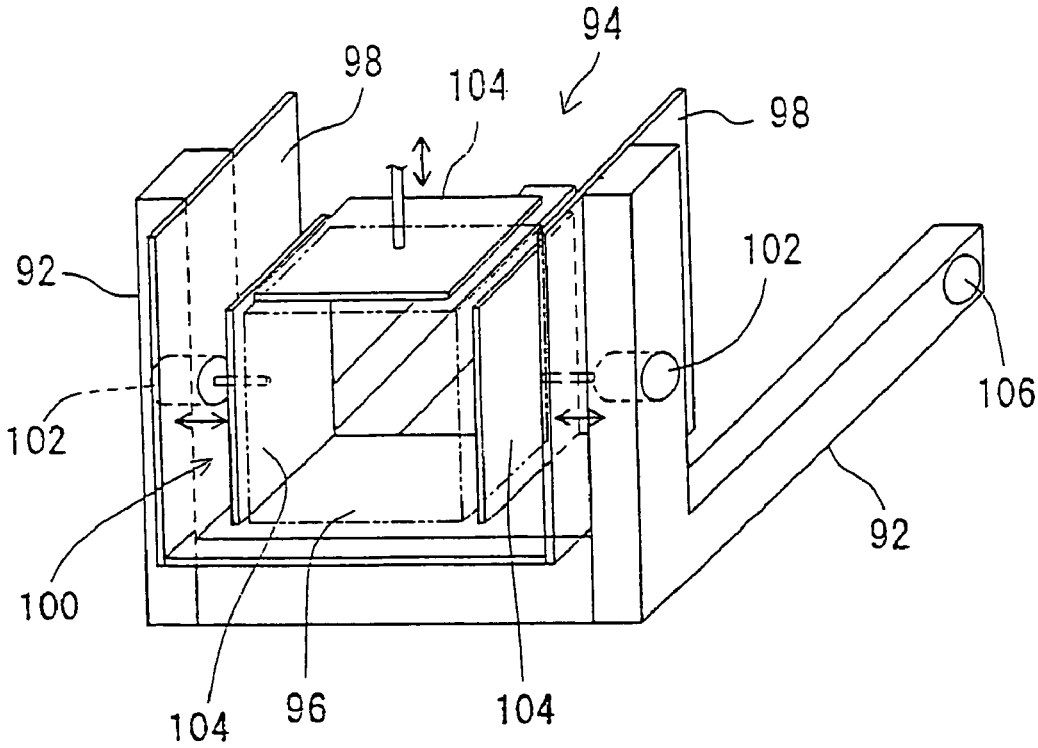
FIG. 8 is an enlarged, perspective view for explaining the essential portion of the rotation device.

In FIGS. 1, 3, 4 and 7, L-shaped arms 92 are pivoted 90 degrees within the frame assembly 12 so they assume either an upright or a horizontal position. As is shown in FIG. 8, a rotation frame 94, having a clamp mechanism 100, is attached to the distal ends of the linear portions extending from the base portions of the L-shaped arms 92.

In this embodiment, the rotation frame 94 is an inverted C shaped plate frame that is formed by connecting three side plates. Specifically, the L-shaped arms 92, extended in parallel, are connected to provide a bottom plate 96, and side plates 98 are attached to the linear portions at the distal ends of the L-shaped arms 92. Then, the bottom plate 96 and the side plates 98 are coupled to obtain the inverted C shaped frame plate 94.

The clamp mechanism 100 includes: clamp cylinders 102, which are air cylinders, supported by the rotation frame 94, whose rods are moved forward and retracted from both sides and the top face (not shown) within the inverted C shape; and three clamp plates 104, which are fixed to the cylinder rods of the clamp cylinders 102 and which have perpendicular faces that are moved forward and backward between the side faces and the top face of the inverted C-shaped frame, inside the rotation frame 94. While a mold M is mounted on the bottom plate 96 in the inverted C shaped frame, the clamp plates 104 are moved forward from the sides of the three perpendicular faces and the mold M is gripped or separated.

The rods of the air cylinders that secure the clamp plates 104 exert a clamping force that presses the clamp plates 104 against and securely grips, but does not destroy, the mold M so it can be moved through the air.

As is shown in FIGS. 3, 10, 11 and 13, when a bare mold M in the vertical form has been extruded, the bare mold M is accepted by the rotation frame 94 and its outer faces are clamped, so that the mold M is held, unchanged, in the vertical form. Then, as the L-shaped arms 92 are pivoted at a shaft 106, the rotation frame 94 rotates the mold M 90 degrees to change its position from the upright to the horizontal.

An operating rod 108 is fixed to one of the L-shaped arms 92, and is so connected thereto, at the shaft 106, that it forms an inverted seven shape. Further, a cylinder 110 is connected to the end of the operating rod 108, and as the drive cylinder 110 moves the operating rod 108 horizontally, the L-shaped arms 92 are pivoted at the shaft 106.

The drive cylinder 110 is horizontally driven by hydraulic force. As is shown in FIG. 3, the drive cylinder 110 is able to rotate in directions indicated by a double-headed arrow, shown to the right of a shaft 112, in order to absorb the linear movement of the drive cylinder 110 and the pivoting movement of the operating rod 108. As the L-shaped arms 92 are rotated at the shaft 106, the rotation frame 94, which is fixed to the distal linear end portions of the L-shaped arms 92, is rotated 90 degrees from the horizontal position, where the mold M is accepted at the extrusion face, to the upright position. Since the rotation frame 94 is displaced and moved to a horizontal position where the rotation frame 94 is transversely arranged, the form of the mold M held in the frame is changed from the vertical to the horizontal.

In this embodiment, the L-shaped arms 92, the mechanism for driving the L-shaped arms 92 and the rotation frame 94 attached to the L-shaped arms 92 constitute the rotation device 114, which rotates front and rear extruded molds Mp and Mq to provide a vertical lamination of the molds.

When the form converter 16 is in the active mode, the L-shaped arms 92 are pivoted between the position whereat the mold M extruded by the rotation device 114 is accepted in the vertical form, and the position whereat rotation has caused the form of the mold M to be changed to the horizontal. When the form converter 16 is in the inactive mode, the clamp plates 104 are retracted and the linear portions of the L-shaped arms 92 are upright, so that the mold can pass through the rotation frame. At this time, a lower frame, which will be described later, is raised, and the front die 90 is rotated until it is upright, so that the mold M can pass through the space in the frame.

The mold alignment device 115 is means for aligning and vertically laminating one of the two molds previously transported with the other, and for transporting the molds to the pouring line. In this embodiment, the mold alignment device 115 includes: a mold alignment frame 118, which holds and vertically moves, relative to the rotation frame 94 that has been rotated 90 degrees and is currently horizontally positioned, a previously transported mold and which interacts with the rotation frame 94 to perform mold alignment; and a vertically moving plate.

The mold alignment frame 118 is a mold gripping device that grips, as needed, a mold M located inside, and that vertically moves the mold M in this state. In this embodiment, the mold alignment frame 118 includes the same mechanisms as the clamp mechanism 100, which clamps a mold M.

The mold alignment frame 118 is, for example, a four-sided square frame that is open on two sides. The mold alignment frame 118 is positioned so that its top and the bottom are open, and is linearly raised or lowered, in this state, between an upper limit position and a lower limit position by a vertically moving cylinder 119, as is shown in FIG. 3. The mold alignment frame 118 internally includes the same clamping mechanism as does the rotation frame 94, with the internal face of one of the plates constituting the square mold alignment frame 118 being regarded as a reference plate. Clamping plates (not shown), driven by an air cylinder, are moved inward or outward relative to the three perpendicular faces to apply a predetermined clamping force to the mold and move it vertically.

A vertical moving plate 120 interacts with the mold alignment frame 118, while separate drive sources are provided for the plate 120 and the frame 118. The vertical moving plate 120 is linearly raised and lowered by a drive cylinder 122 along a guide mechanism (not shown). In this embodiment, the vertical moving plate 120 is raised or lowered while linearly sliding along the square shape of the mold alignment frame 118.

As is described above, immediately under the mold M that has been rotated 90 degrees and is currently in the horizontal state, the mold alignment device 115 is linearly raised and lowered relative to the front mold in the vertical lamination arrangement. Then, the mold alignment frame 118 and the vertical moving plate 120 interact to align the molds and to form a correct pouring gap. Thereafter, the molds, in the same form as when pouring is performed from above, are laminated and are transported to the pouring line.

The mold alignment device 115 is also activated when the horizontal molding function is selected. When the vertical molding function is selected, the mold alignment device 115 is in the inactive state, i.e., it is retracted that it does not interfere with the passage of a mold that is being extruded.

More specifically, in FIG. 7A, the mold alignment device 115 grips two vertically laminated molds M and rotates them 90 degrees so that the front and rear molds are laminated horizontally, as is shown in FIG. 7B, while at the same time holding the molds M so that the horizontal state is maintained.

At this time, the mold alignment frame 118 and the vertical moving plate 120, which hold the previously produced mold, are raised. Then, the clamp mechanism 100 and the vertical moving plate of the rotation frame 94 and the mold alignment frame 118 cooperate to correctly align a previously transported mold Mr with a lower mold Mq that was rotated and laminated vertically. Thereafter, the mold alignment frame 118 and the vertical moving plate 120 are lowered to the level for conveying the mold to the pouring line, and the molds are transported horizontally.

The upper mold Mp, which was rotated and laminated vertically, is held by the mold alignment frame 118, and in this state, is lowered to the lower limit position for the conveying line level, where it is to be aligned with the next mold that is rotated and laminated vertically. Following this, while the port for pouring molten metal opens upward, as in the vertical mold lamination shown in FIG. 7, and while the upper mold Mq is held by a supporting tool (not shown), the molds are transported to the pouring line, and pouring is sequentially performed.

Furthermore, as is shown in FIG. 4, an extrusion cylinder unit 128 is located near the mold alignment device 115, and includes: an extrusion plate 124, which can be projected toward or retracted from the plane to which where the mold M is extruded; and a plate extrusion cylinder 126. The extrusion cylinder unit 128 is projected toward or retracted from the mold extrusion plane, as needed, so that the molds Mq and Mr that are aligned in the vertically laminated form are extruded and transported to the pouring line.

That is, the vertical moving plate 120 halts, at the same level as the extrusion plane, the previous mold Mr and the lower mold Mq that have been rotated and vertically laminated, and which are correctly aligned. In this state, the extrusion cylinder unit 128 is driven and transports the molds to the pouring line.

As is described above, the form converter 16 is means for rearranging the mold M in the vertically split form, extruded by the molding section, and providing a vertically laminated mold arrangement. When molding is initiated by the molding and transporting apparatus, and when the horizontal molding function is selected in advance, the form converter 16 performs form conversion by rotating the mold 90 degrees.

Therefore, when the vertical molding function is selected, the division plate 86, which constitutes the dividing mechanism 18 and the pouring port formation mechanism 20, is not moved forward into the molding space S, and only a single mold is produced, for which a pattern, corresponding to a model, is formed in the front and rear faces. At this time, the form converter 16 is not activated.

That is, the front frame 42 is separated from the die and the front die 22 is rotated forward to the upright position, and the mold is horizontally extruded through the opening in the center of the front die 22. At this time, the form converter 16 is not activated, and merely the extrusion operation is repeated to sequentially transport molds to the pouring line.

The operation of the molding and transporting apparatus according to the embodiment will now be described while referring to FIGS. 2, 9 and 15. First, the processing performed by the molding and transporting apparatus, when the function for a horizontal molding machine is selected, will be described while referring to flowchart steps S1 to S6, for molding, and S51 to S56, for form conversion and transportation, in FIG. 15. The state shown in FIG. 9 corresponds to flowchart stage (1) in FIG. 15.

Figure 9:
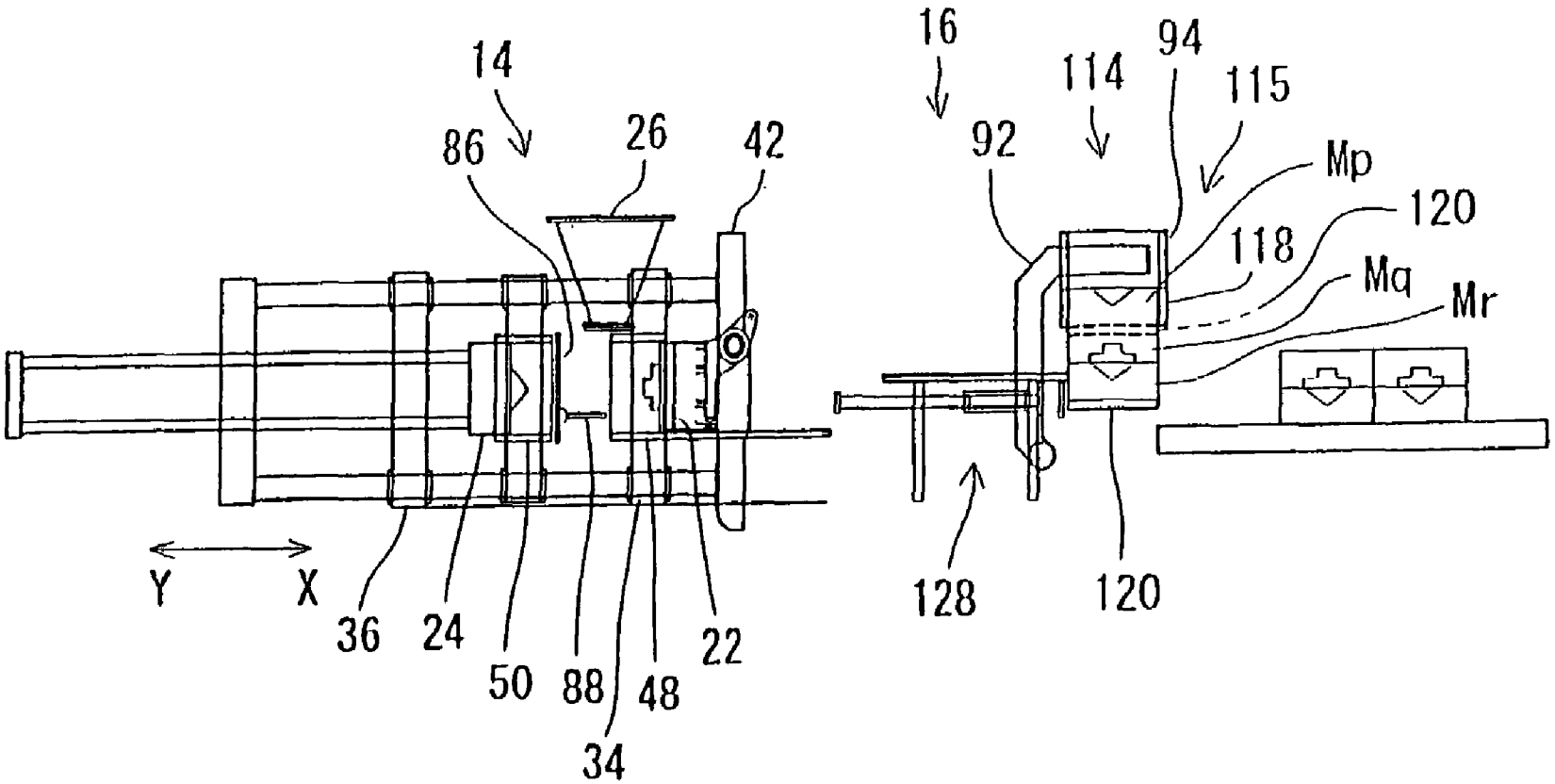
FIG. 9 is a diagram for explaining the operation of the molding and transporting apparatus according to the first embodiment of the present invention.

In FIG. 9, in the molding section 14, the second drive cylinder 52 is extended and the rear shuttering 50 and the movable frame 68, as well as the rear die 24, are jointly moved forward in direction X, i.e., are slid toward the pouring line. Below the propulsion port of the sand tank 26, the front and rear shutterings 48 and 50 are brought into contact and closely aligned to define a parallelepiped gap. Then, inside the shutterings 48 and 50, the front and rear dies 22 and 24 are positioned opposite each other to define a closed molding space S (step S1).

At this time, on the form converter 16 side, the L-shaped arms 92 are upright and the mold alignment frame 118 is located near the rotation frame 94. Subsequently, the clamp mechanisms 100 for these frames are opened, and the vertical moving plate 120, on which three previously released laminated molds are mounted (i.e., the molds Mp and Mq, which have been rotated 90 degrees, and the previously transported mold Mr), is lowered. Then, the extrusion cylinder unit 128 is elevated and projected forward to the extrusion plane (step S51).

Figure 10:
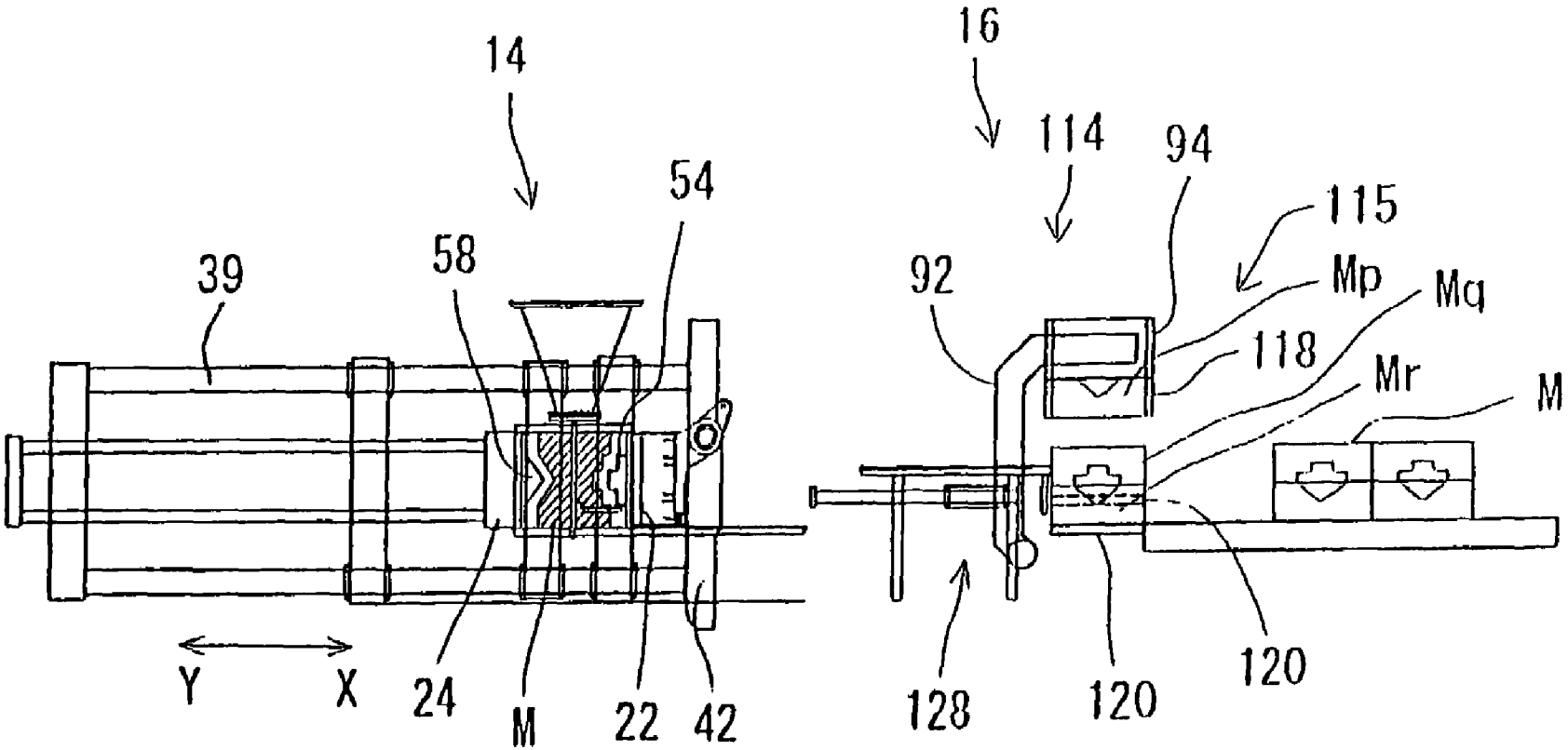
FIG. 10 is a diagram for explaining the operation of the molding and transporting apparatus according to the first embodiment of the present invention.

At stage (2), the molding section 14 in FIG. 10 blows sand into and fills the molding space S. After the molding space S has been filled with sand (position indicated by a solid line), the compression cylinder 72 is activated and drives the entire rear die 24 in direction X. At the same time, the first drive cylinder 44 is activated and moves the rods 38 to 41 and the front frame 42 in direction Y. As a result, the blown sand is compacted by pressure applied from the front and the rear (see the shaded portion in FIG. 10). Thereafter, the hydraulic pressure is released (step S2).

Figure 14:
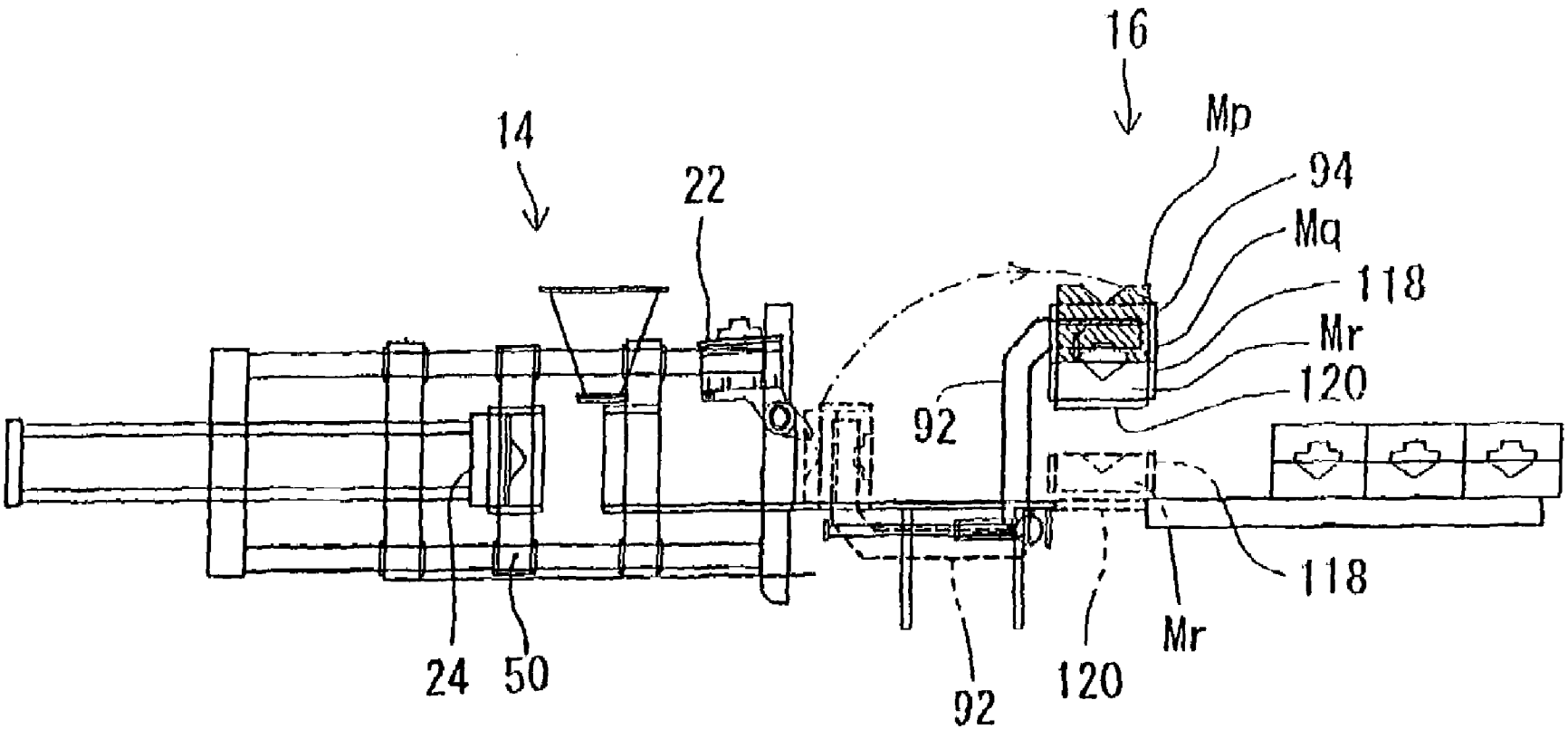
FIG. 14 is a diagram for explaining the operation of the molding and transporting apparatus according to the first embodiment of the present invention.

At stage (2), in the form converter 16 in FIG. 14, the vertical moving plate 120 on which three laminated free molds are mounted descends to a position indicated by a broken line, so that the topmost of the three molds, mold Mp, is stored in the rotation frame 94 and the mold alignment frame 118, which are vertically aligned and communicate with each other internally.

Following this, the clamping mechanism 116 of the mold alignment frame 118 is activated to hold the mold Mp, and in this state, the vertical moving plate 120 is lowered. As a result, the two molds Mq and Mr, which are correctly aligned, are lowered and halted at the same level as the pouring line (step S52).

Figure 11:
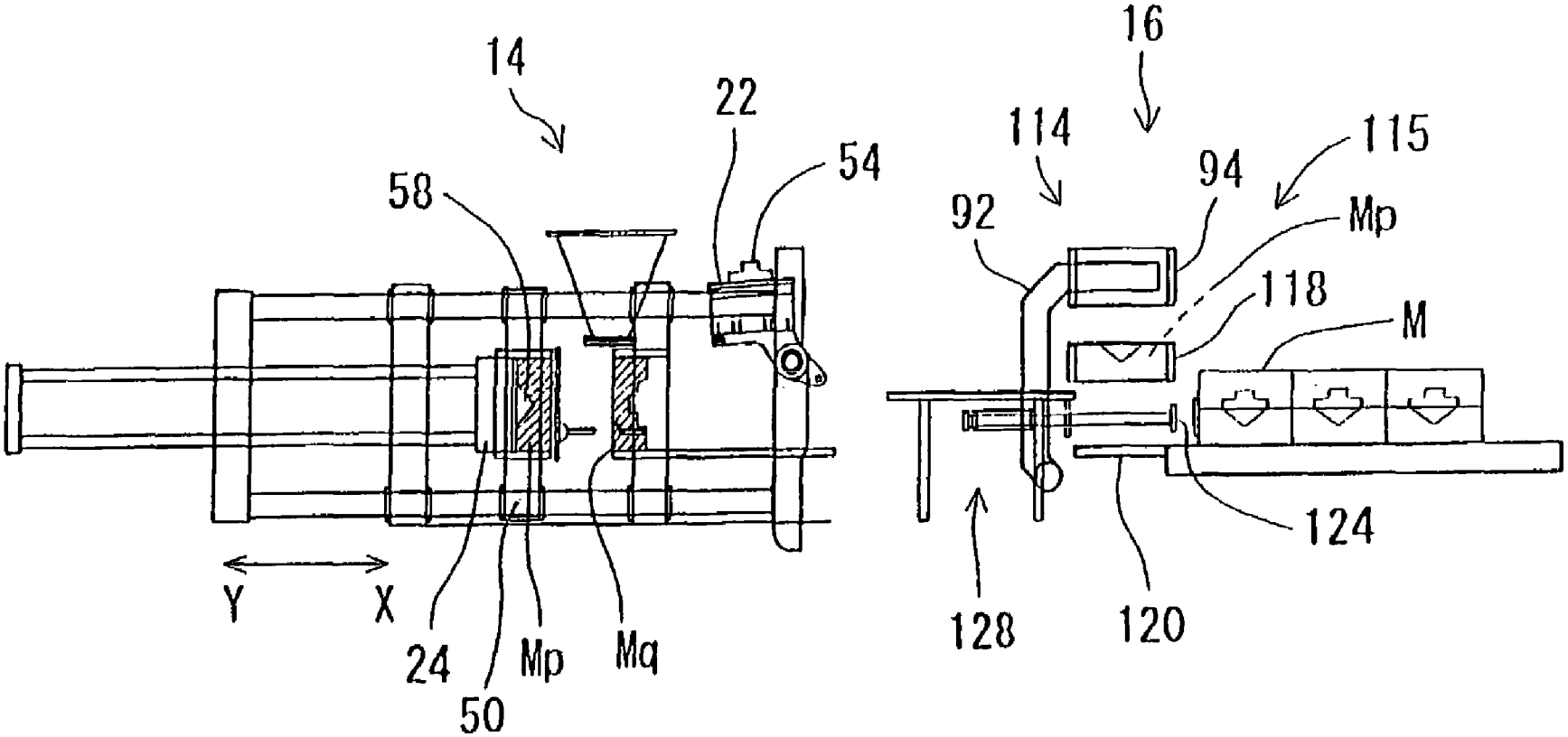
FIG. 11 is a diagram for explaining the operation of the molding and transporting apparatus according to the first embodiment of the present invention.

At stage (3), in the molding section 14 in FIGS. 9 and 11, the drive cylinder is driven to separate the front die 22 from the rear die 24, and the front frame 42 is moved to the rotation position for the front die 22. Then, the front die 22 is rotated about 90 degrees to the upright position to open the passage for the extrusion of the two molds Mp and Mq. At the same time, the rear die 24 and the rear shuttering 50 are retracted in direction Y, as is the division plate 86 to which the pouring port rod 88 is fixed (step S3).

At stage (3), in the form converter 16, the plate extrusion cylinder 126 of the extrusion cylinder unit 128 is activated and extrudes, to the pouring line, the molds Mq and Mr that are vertically laminated by the extrusion plate 124. At the same time, lowering of the mold alignment frame 118, which holds the topmost mold Mp, is begun and the rod of the extrusion cylinder 126 is retracted (step S53).

Figure 12:
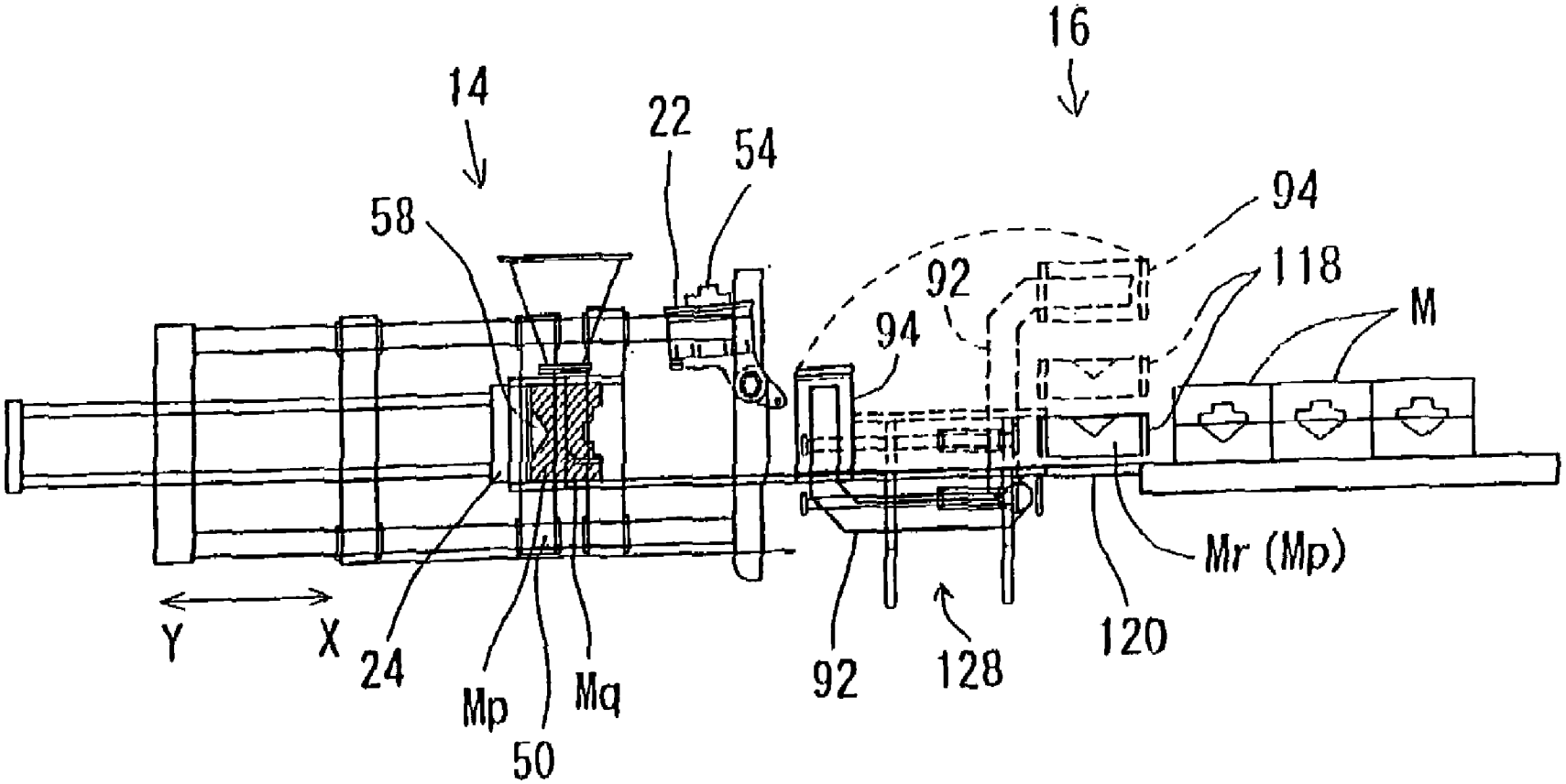
FIG. 12 is a diagram for explaining the operation of the molding and transporting apparatus according to the first embodiment of the present invention.
Figure 15:
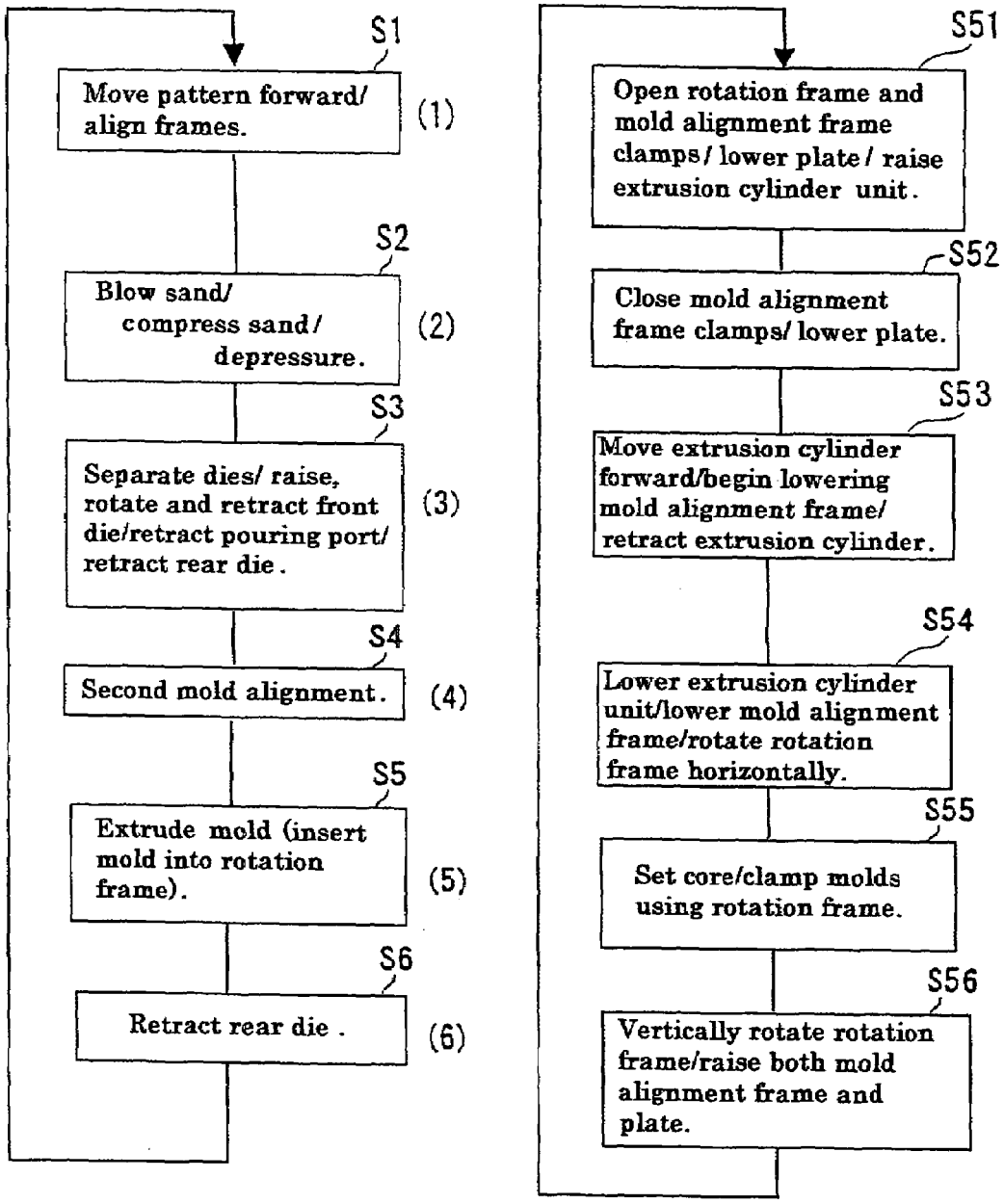
FIG. 15 is a flowchart for explaining one cycle of the processing performed by the molding and transporting apparatus according to the first embodiment of the present invention.

In FIG. 12, which corresponds to stage (4) in FIG. 15, the compound functional member 90, including the pouring port formation mechanism 20, in the molding section 14 is retracted, and the rear die 24 and the rear shuttering 50 are moved forward in direction X to perform the second alignment for the shutterings and the front and rear molds (step S4).

At this time, the extrusion cylinder unit 128 in the form converter 16 is lowered and retracted from the extrusion plane, and in addition, the mold alignment frame 118, which holds the mold Mp, is lowered and halted at the lower limit position. At the same time, the L-shaped arms 92 are rotated 90 degrees, to their original horizontal position, and are halted at the mold acceptance position to wait for the next mold that is extruded (step S54).

Figure 13:
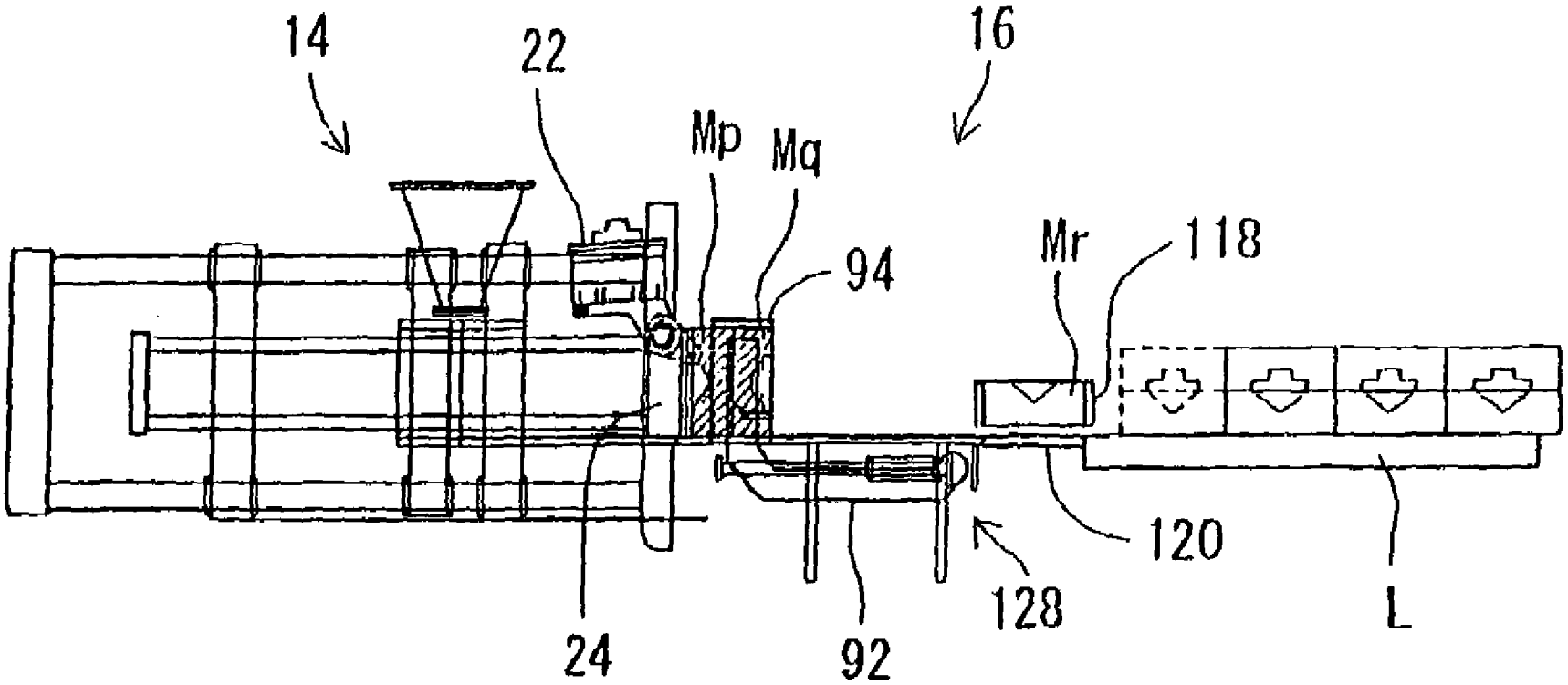
FIG. 13 is a diagram for explaining the operation of the molding and transporting apparatus according to the first embodiment of the present invention.

In FIG. 13, which corresponds to stage (5) in FIG. 15, two horizontally laminated molds in the molding section 14 are extruded, by the extrusion rod 62, to the pouring line (to the right in FIG. 13), where they are halted when mounted on the bottom plate 96 of the rotation frame 94 of the rotation device, which is in the standby state. Then, the clamp mechanism 100 of the rotation frame 94 impels the clamp plates 104 inward until they press against and hold the molds (step S5).

At this time, the L-shaped arms 92 in the form converter 16 are rotated to the horizontal position, and the mold alignment frame 118 is lowered and halted at the lower limit position. Therefore, the core is positioned as required, while above the preceding mold, which in the mold alignment process is to be a lower mold, no obstacles are present that can interfere with the operation (step S55).

In FIG. 14, which corresponds to stage (6) in FIG. 15, the rear die 24 and the extrusion rod 62 in the molding section 14 are retracted, as is the rear shuttering 50, to wait for the next molding cycle (step S6).

At this time, the L-shaped arms 92 in the form converter 16 are rotated 90 degrees, to the upright position, while holding the two vertically arranged bare molds Mp and Mq so that their lamination aspect changes from horizontal to vertical.

Then, the mold alignment frame 118 holding the mold Mr is raised, along with the vertical moving plate 120, and as is indicated by solid lines, engages the bottom of the rotation frame 94. Furthermore, the vertical moving plate 120 is brought into contact with the lower face of the mold alignment frame 118 (step S56). Thereafter, the molding section 14 and the form converter 16 synchronously repeat the processes at steps S1 to S6 and S51 to S56 to sequentially perform the horizontal molding function, and the pouring operation is performed.

Figure 16:
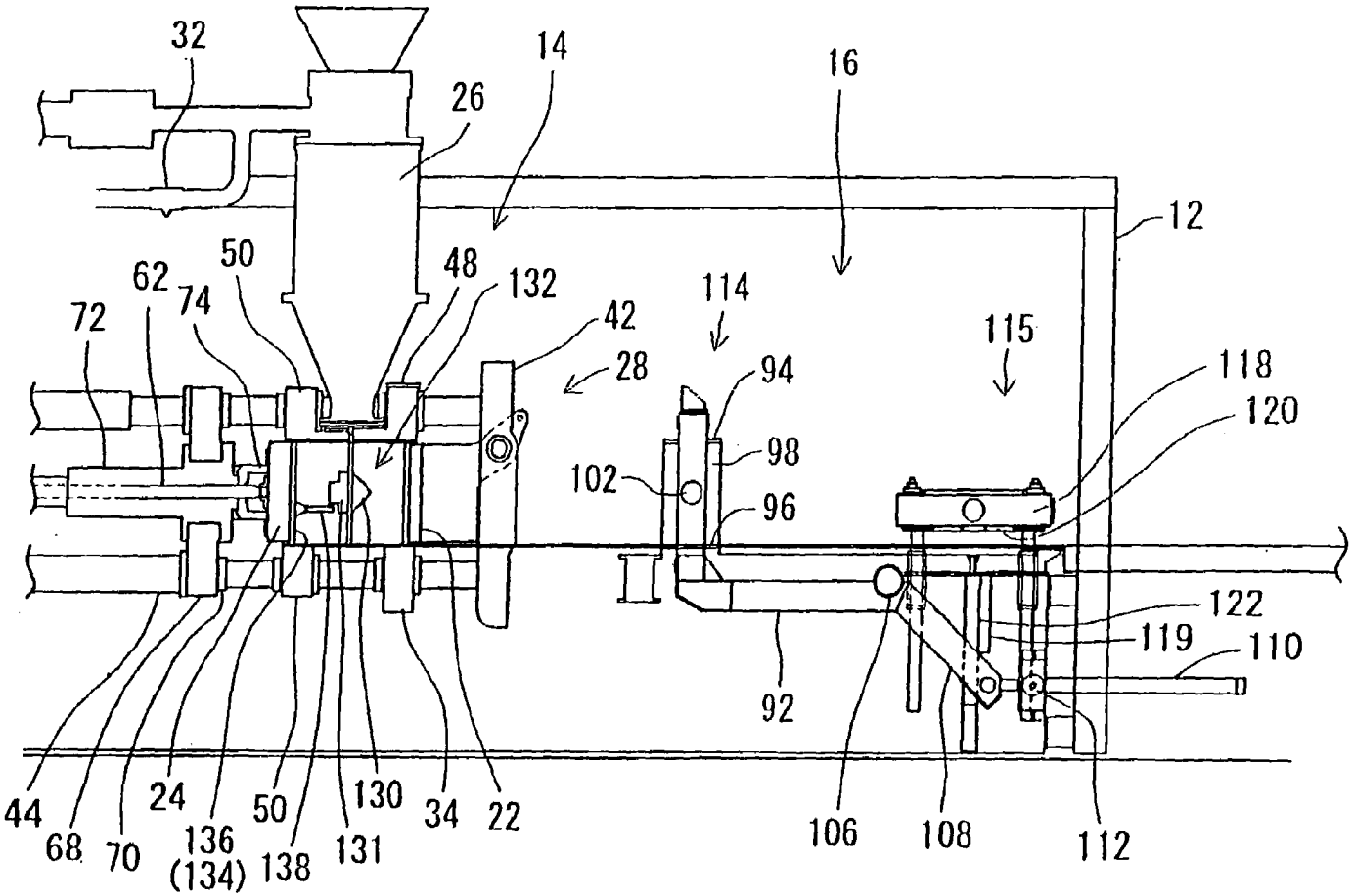
FIG. 16 is a partially omitted side view of the essential portion of a molding and transporting apparatus according to a second embodiment of the present invention.
Figure 17:
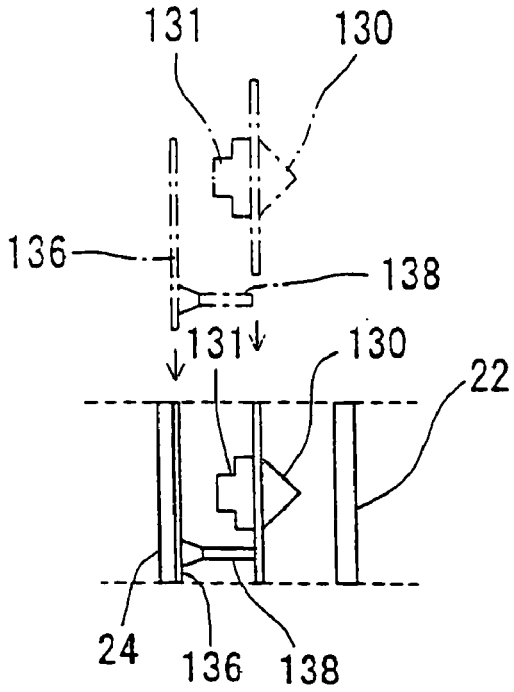
FIG. 17 is a schematic diagram for explaining the operation of a molding section shown in FIG. 16.

A second embodiment of the present invention will now be described while referring to FIGS. 16 and 17. Since reference numerals used to denote components in the first embodiment are again employed to denote corresponding components in this embodiment, detailed explanations for them will not be given.

According to the second embodiment, a molding and transporting apparatus comprises the molding section 14 and the form converter 16, as used in the first embodiment. However, the main differences between the two embodiments is that, in consonance with a difference between a pattern plate and a match plate used as a patterning method for a mold, the match plate is employed as a patterning die member, and that a pouring port formation mechanism is inserted or retracted by a driving source that differs from the one used for inserting the match plate.

That is, in this embodiment, the molding and transporting apparatus includes an insertion/retraction mechanism 132. And as is shown in FIG. 17, the insertion/retraction mechanism 132 can insert, into a molding space S, a match plate, for which patterns 130 and 131 are formed in both sides of a division plate 86, or can retract the match plate from the molding space S while the match plate is upright.

Before blowing sand to the molding space, the match plate of the insertion/retraction mechanism 132 is inserted, as needed, to a middle location in the molding space by an insertion/retraction device, such as an air cylinder mechanism (not shown). That is, when the molding and transporting apparatus is used as a horizontal molding machine, the state of the match plate can be selected, i.e., it is freely inserted into, or retracted from the molding space.

Further, a pouring port formation mechanism 134 is provided that is selectively driven to form a pouring port in a final mold. In this embodiment, an upright pouring port rod 138 is provided that is perpendicular to a flat plate 136, and is inserted into or retracted from the molding space S by an insertion/retraction device, such as an air cylinder mechanism in the molding space S that is positioned inward of a rear die 24.

The molding and transporting apparatus further comprises: a form converter, for selectively performing processing in either an active mode, for accepting mold segments that are obtained, by vertically dividing a mold using the match plate, and are extruded by the molding section and for vertically laminating the mold segments to provide a horizontally split form, or in an inactive mode, for transporting to a pouring line, without changing the form, molds that are extruded by the molding section. When either mode is selected, the molding and transporting apparatus can serve as a horizontal molding machine. When the apparatus serves as a vertical molding machine, the molding process and the mold alignment process can be sequentially performed in the same manner as in the first embodiment.

As is described above, by using an expensive match plate, which is also used for a conventional molding machine, a molding and transporting apparatus that provides the advantages of both vertical and horizontal molding machines, and that also enables both vertical and horizontal molding, can be provided at a lower cost than a conventional molding machine that employs vertical molding pattern plates that require two pattern faces.

In this case, the form converter 16 may include: a rotation device 114 for rotating two front and rear molds to provide an arrangement wherein the rear mold (Mq) is placed on the front mold (Mp); and a driving mechanism for transporting, to a pouring line, the molds in an arrangement obtained when the rotation device 114 has rotated the molds.

In the active mode of the form converter 16, the outer faces of the molds may be gripped to change a vertically split form to a horizontally split form. This process can be performed using the same configuration as was explained for the first embodiment.

When the match plate is employed for a machine that can enable both vertical and horizontal molding, form conversion is performed while a correct pouring gap is formed using the pattern, and alignment is performed by using correct molds, so that the alignment step explained in the first embodiment is not required. However, when an operation for inserting a core into the upper and lower molds that have been rotated is required, the mold alignment frame 118 in the first embodiment is used as a core insertion opening frame. At this time, the core is positioned while the mold alignment frame 118, in cooperation with the vertical moving frame 120, opens the upper and lower molds.

Therefore, in this case, the same structure as in the first embodiment can be used for the mold alignment device, and only the control operation need be changed, in order for the molding and transporting apparatus in this embodiment to serve as a multi-functional molding machine that provides the same effects as those obtained in the first embodiment.

In the first and the second embodiments, the apparatus that enables both vertical and horizontal molding has been explained. However, a special horizontal molding machine can also be provided.

In this case, in the first embodiment, for example, the molding and transporting apparatus comprises:

the molding section 14, for defining, using the shutterings 48 and 50, the molding space S between the front and rear dies 22 and 24, which are located horizontally opposite each other and on which pattern faces are vertically located, and for, after sand has been vertically blown from above and the molding space S has been filled, driving the front and rear dies 22 and 24 to form a mold M and extruding the mold M horizontally;

a dividing mechanism for, before propulsion of the sand into the molding space S, vertically dividing the mold M at the middle position of the molding space S to obtain front and rear mold segments;

the pouring port mechanism 88 (FIG. 6) for forming a pouring port in the mold M; and the form converter 16 for laminating only bare molds M, which have been extruded from the molding section, and changing the vertically split form to a horizontally split form, and for transporting the molds, in this form, to the pouring line.

Figure 6:
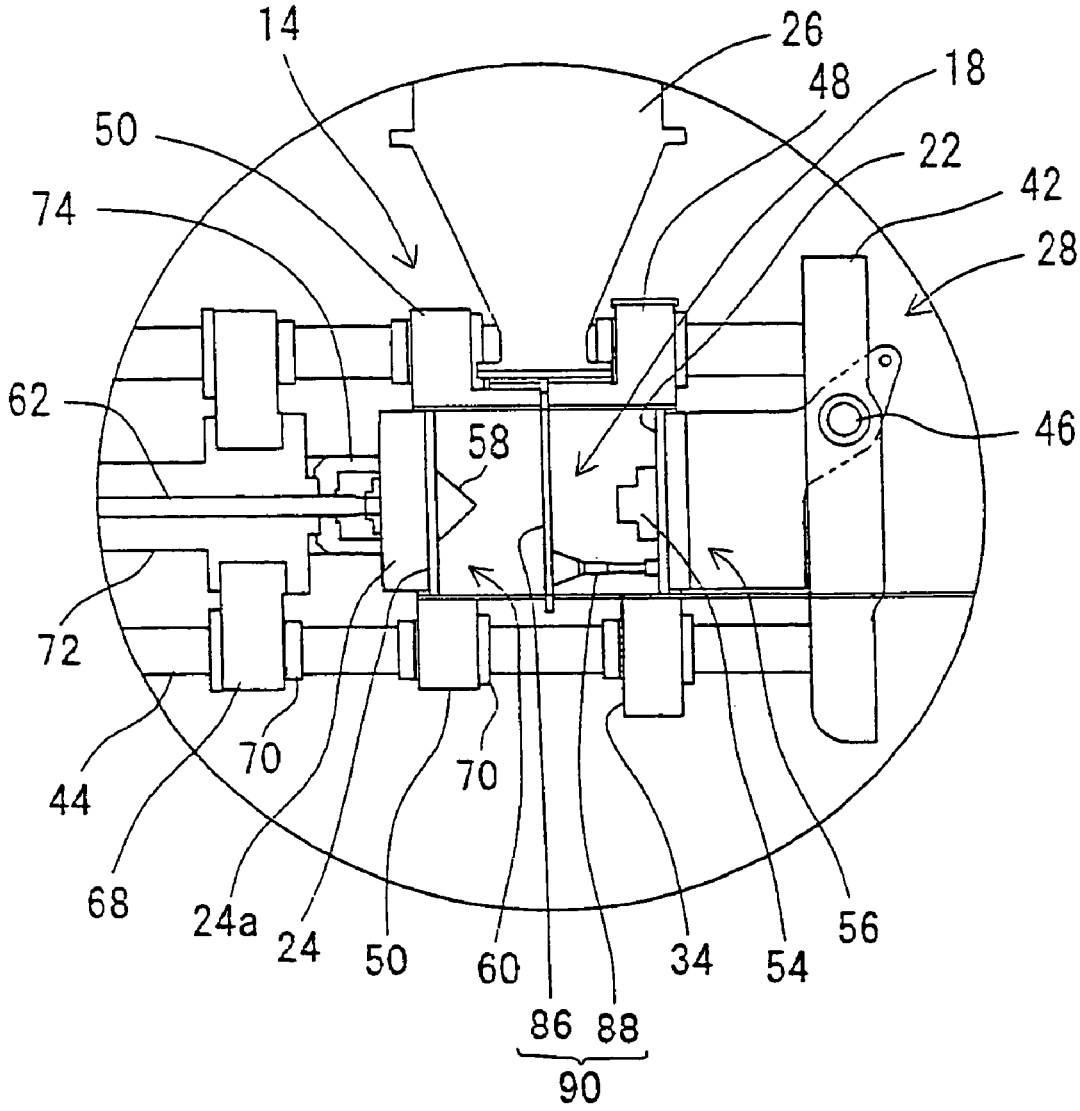
FIG. 6 is an enlarged diagram for explaining the structure and the operation of the essential portion of the molding and transporting apparatus in FIG. 1, wherein the compound function members of a molding section are operated.
Figure 7:
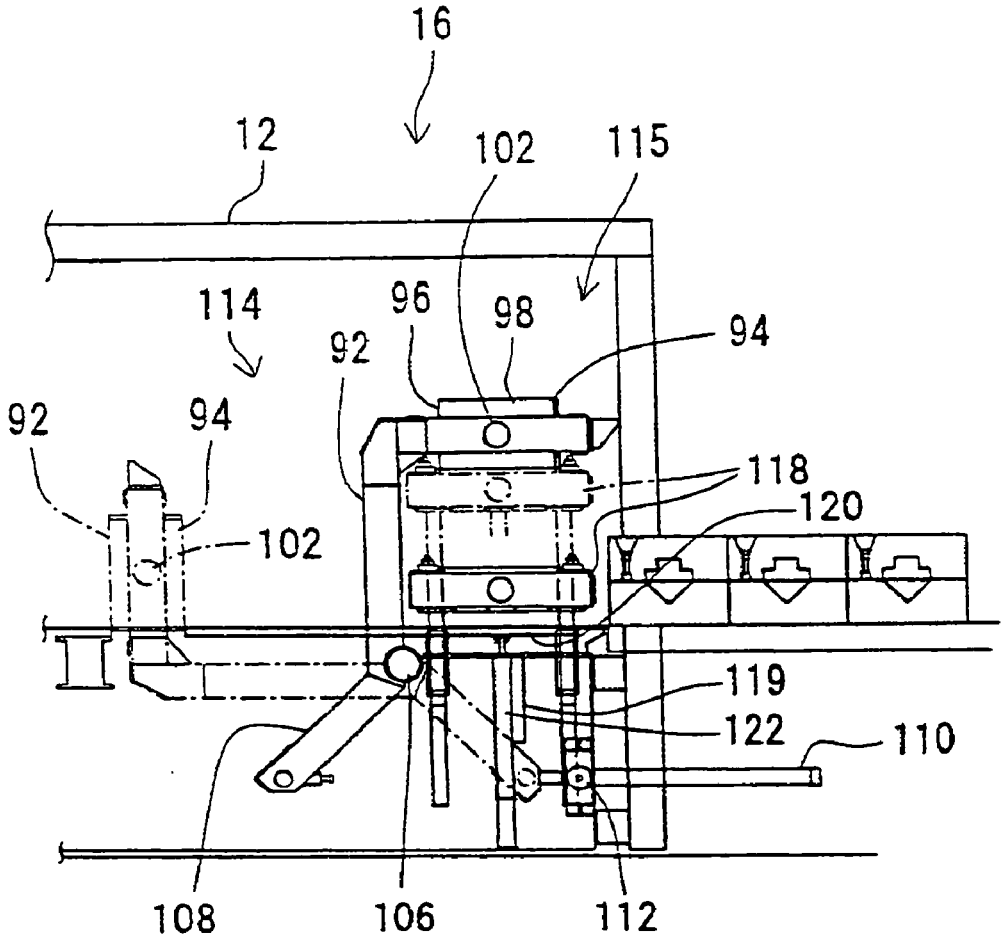
FIG. 7A is an enlarged diagram for explaining the operation of the essential portion of a form converter.
FIG. 7B is a diagram for explaining the alignment of vertically laminated molds in FIG. 7A.
Figure 7:
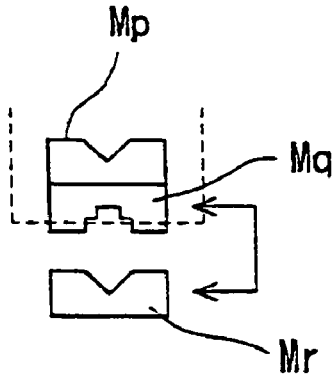

At this time, in the first embodiment, before the molding space S is filled with sand, the division plate 86 in FIG. 6, to which the pouring port rod 88 is attached, is always inserted into the molding space that is to be divided vertically. Further, the rotation device 114 and the mold alignment device 115 of the form converter 16 are always activated to change the horizontal lamination of the molds to the vertical. Then, a pair of upper and lower, correctly aligned molds is transported to the pouring line.

Figure 18:
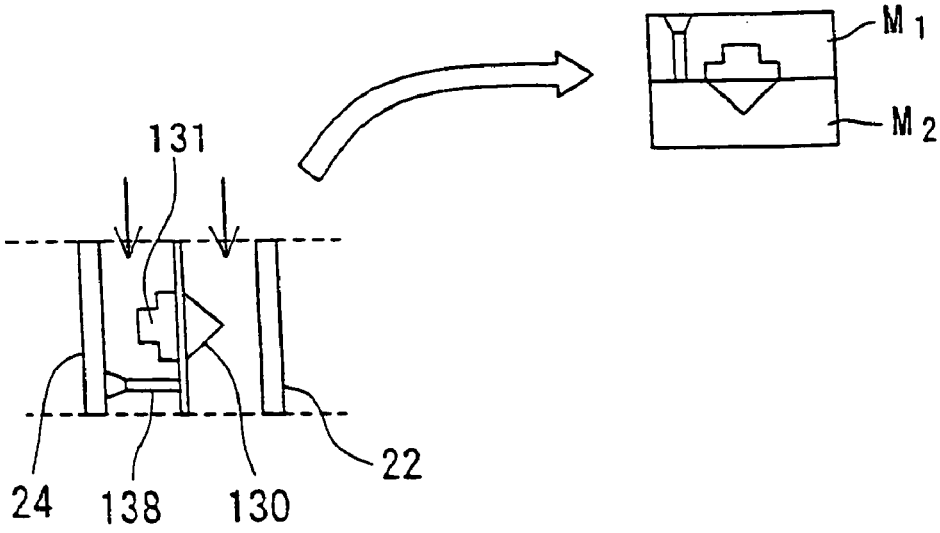
FIG. 18 is a diagram for explaining the conceptual structure and the operation of a molding section when a match plate is employed to provide a special horizontal molding machine.

Furthermore, as is shown in FIG. 18, when the match plate wherein patterns are formed in both sides of the flat plate is inserted into or retracted from the molding space S, the pouring port rod 138 is fixed upright, directly to the rear die 24 in direction X, and the match plate can be freely inserted into or retracted from the molding space S. Thus, the molding and transporting apparatus can serve as a special horizontal molding machine that uses a match plate. And naturally, the molding machines described in the first and the second embodiments can be so set they can be used as special vertical or horizontal molding machines.

As is described above, the molding and transporting apparatus of the invention and the method therefor employs a vertical molding method, which comprises the steps of:

defining a molding space, through the shutterings, between the front and rear dies, which are located horizontally opposite each other and on which patterns faces are vertically arranged, and vertically blowing sand from above into the molding space and filling the molding space; and impelling the front and rear dies, after the sand has filled the molding space, and producing a mold. When the mold that is produced is to be transported to a pouring step using the vertical molding method, basically, the mold (Mp or Mq) is extruded by the vertical molding section 14 and combined with a mold that was previously transported and that has a corresponding pattern, and the pair of molds that are obtained are vertically laminated and are transported to the pouring step.

With this configuration, only a bare sand mold, for example, need be rotated and combined with another mold for the vertically laminated molds to be transported. Further, the rotation radius can be reduced to save space, and only a small power load is required. In addition, the cycle time for the processing can be shortened, and vertical propulsion and satisfactory compaction are ensured. Furthermore, a molding apparatus can be provided that can selectively perform, as needed, the vertical or the horizontal molding function.

According to the invention, the molding and transporting apparatus and the method therefor described above are not limited to the embodiments, and can be variously modified without departing from the subject of the present invention described in the claims. For example, an automatic core setter for vertical molding may be located near the plane whereat the mold is extruded from the molding section to the form converter.

As is described above, a molding and transporting apparatus according to one aspect of the present invention comprises:

a molding section for using shutterings to define a molding space between a front die and a rear die, horizontally arranged opposite each other, that have vertically formed pattern faces, for, after sand has been vertically blown into the molding space from above, driving the front and rear dies and compacting the sand to produce a mold, and for extruding the mold horizontally;

a dividing mechanism for, before the sand is blown into the molding space, vertically dividing the mold into front and rear portions, as needed, at the center of the molding space;

a pouring port formation mechanism for using the faces of the mold segments obtained by vertical division to form a pouring port in the mold; and a form converter for selectively rendering an active operation for vertically laminating only the mold segments of the mold that are extruded from the molding section and changing the form of the mold, and a non-active operation for transporting, to a pouring line, the mold extruded by the molding section, without changing the form of the mold.

Therefore, a small apparatus can be provided, at a low cost, whereby a simple core setting operation can be performed as needed and core support reliability, improved product precision, reduced molding time and satisfactory compaction are ensured. Further, only a single unit is required to provide a multi-functional molding and transporting function in the vertical molding mode or in the horizontal molding mode. Since the molding section and the form converter are handled along a serial line, both the core setting operation and the molding operation can be performed at the same time. Thus, between the steps, a waiting period is eliminated, and the overall molding time can be considerably reduced.

The form converter for selectively converting the mold into a vertical split form or a horizontal split form includes:

a rotation device for rotating a front mold and a rear mold that have been extruded, and for vertically laminating the two molds to obtain a horizontally split form; and a matching device for aligning a previously transported mold and one of the molds in the horizontally split form to assemble a horizontally split form, and for transporting the assembly comprising the molds to a pouring line. With this configuration, since only bare molds are held and rotated and a vertical arrangement can be changed to a horizontal arrangement within only a small operating radius, the space required and the power load can be reduced. Furthermore, since a mold that is rotated and a preceding mold can be correctly aligned by the mold alignment device, the pair of molds that are thus obtained can be smoothly transported to the pouring line.

The dividing mechanism includes:

a division plate to be inserted into and retracted from the molding space that is to be vertically divided. The pouring port formation mechanism 20 includes a pouring rod 88 that projects outward horizontally from the division plate 86. With this configuration, since the pouring port can be formed by using the division plate, and since the separation of dies and the formation of a pouring port can be performed at the same time, simplification of the components and of the manufacturing process and a reduction in the manufacturing costs can be attained.

Furthermore, in the active mode of the form converter, the outer faces of the mold are directly clamped to change a vertically split form of the mold into a horizontally split form. With this configuration, since only bare molds extruded to the form converter need be gripped, positioning for the alignment or for the adjustment of the inclination of the molds can be freely performed.

According to another aspect of the invention, a molding and transporting apparatus comprises:

a molding section for using shutterings to define a molding space between a front die and a rear die, horizontally arranged opposite each other, that have vertically formed pattern faces, for, after sand has been vertically blown into the molding space from above, driving the front and rear dies and compacting the sand to produce a mold, and for extruding the mold horizontally;

a match plate insertion/removal mechanism for, before sand is blown into the molding space, inserting a match plate, in which a pattern face is vertically formed, into the middle point in the molding space, as needed;

a pouring port formation mechanism that is driven, as needed, to form a pouring port in the mold; and a form converter for selectively rendering an active operation for vertically laminating only the mold segments of the mold that are obtained by the match plate and are extruded from the molding section and for changing the form of the mold, and a non-active operation for transporting, to a pouring line, the mold extruded by the molding section, without changing the form of the mold. Therefore, a small apparatus can be provided, at a low cost, whereby a simple core setting operation can be performed as needed and core support reliability, improved product precision, reduced molding time and satisfactory compaction are ensured. Further, only a single unit is required to provide a multi-functional molding and transporting function in the vertical molding mode or in the horizontal molding mode. Especially, since the multi-functional molding machine can be provided by employing the match plate used for a conventional molding machine, high pattern formation costs can be reduced.

According to an additional aspect of the invention, a molding and transporting apparatus comprises:

a molding section for using shutterings to define a molding space between a front die and a rear die, horizontally arranged opposite each other, that have vertically formed pattern faces, for, after sand has been vertically blown into the molding space from above, driving the front and rear dies and compacting the sand to produce a mold, and for extruding the mold horizontally;

a dividing mechanism, which is to be activated before sand is blown into the molding space and which, in the molding space, vertically divides the mold at an intermediate position to obtain front and rear mold segments;

a pouring port formation mechanism, for forming a pouring port in the mold; and a form converter, for vertically laminating only the front and rear mold segments extruded by the molding section to provide a mold assembly having a horizontally split form and for transporting the mold assembly to a pouring line. Therefore, a small apparatus can be provided, at a low cost, whereby a simple core setting operation can be performed as needed and core support reliability, improved product precision, reduced molding time and satisfactory compaction are ensured.

According to an additional aspect of the invention, provided is a molding and transporting method, for producing a mold and transporting the mold to a pouring step by employing a vertical molding method that includes the step of using shutterings to define a molding space between a front die and a rear die, horizontally arranged opposite each other, that have vertically formed pattern faces, and vertically blowing sand into the molding space from above, and the step of, after the same has been filled, driving the front and rear dies and compacting the sand to produce a mold, whereby, after the mold has been extruded from a molding section, rotating and aligning the mold with another sand mold having a corresponding pattern, and transporting the mold and the other sand mold to a pouring step. Therefore, a simple core setting operation can be performed as needed and core support reliability, improved product precision, reduced molding time and satisfactory compaction are ensured.

According to a further aspect of the invention, a molding and transporting method, for producing a mold and transporting the mold to a pouring step by employing a vertical molding method that includes the step of using shutterings to define a molding space between a front die and a rear die, horizontally arranged opposite each other, that have vertically formed pattern faces, and vertically blowing sand into the molding space from above, and the step of, after the same has been filled, driving the front and rear dies and compacting the sand to produce a mold, comprises:

a step of horizontally extruding a mold obtained by compaction, and transporting the mold directly to a pouring step;

a first step that includes the steps of before sand is blown into the molding space, vertically dividing the mold at the intermediate position in the molding space to obtain a vertically split mold, forming a pouring port in the mold, and combining two horizontally extruded molds with a previously extruded mold, and transporting the molds to the pouring step; and a second step that includes the steps of after the mold has been produced using the vertical molding method, horizontally extruding the mold without performing the first step, and transporting the mold directly to the pouring step, whereby either the first or the second step is selected to produce and transport the mold. Therefore, a simple core setting operation can be performed as needed and core support reliability, improved product precision, reduced molding time and satisfactory compaction are ensured. Further, only a single unit is required to perform the vertical molding mode or the horizontal molding mode.

At this time, at the first step of combining the two molds that have been extruded horizontally and the previously extruded mold, the two molds are gripped and rotated by a rotation arm mechanism to obtain a vertically laminated arrangement. The first step further includes a step of, before the alignment of the previously extruded mold with one of the two molds, setting a core while an arm of the rotation arm mechanism, which has been rotated horizontally from an alignment section, is retracted at a position for accepting the two molds that have been extruded. With this arrangement, since no obstacle interferes with the core setting operation, the core can be accurately positioned within a short period of time. And furthermore, since the molding and the form conversion processes can be performed at the same time, both the molding period and the cycle time can be reduced.

What is claimed is:

1. A molding and transporting apparatus comprising:

a molding section for using shutterings to define a molding space between a front die and a rear die, horizontally arranged opposite each other, that have vertically formed pattern faces, for, after sand has been vertically blown into the molding space from above, driving the front and rear dies and compacting the sand to produce a mold, and for extruding the mold horizontally;

a dividing mechanism for, before the sand is blown into the molding space, vertically dividing the mold into front and rear portions, as needed, at the center of the molding space;

a pouring port formation mechanism for using the faces of the mold segments obtained by vertical division to form a pouring port in the mold; and a form converter for selectively rendering an active operation for vertically laminating only the mold segments of the mold that are extruded from the molding section and changing the form of the mold, and a non-active operation for transporting, to a pouring line, the mold extruded by the molding section, without changing the form of the mold.

2. A molding and transporting apparatus according to claim 1, wherein the form converter includes:

a rotation device for rotating a front mold and a rear mold that have been extruded, and for vertically laminating the two molds to obtain a horizontally split form; and a matching device for aligning a previously transported mold and one of the molds in the horizontally split form to assemble a horizontally split form, and for transporting the assembly comprising the molds to a pouring line.

3. A molding and transporting apparatus according to claim 1, wherein the dividing mechanism includes a division plate to be inserted into and retracted from the molding space that is to be vertically divided; and wherein the pouring port formation mechanism includes a pouring rod that projects outward horizontally from the division plate.

4. A molding and transporting apparatus according to claim 1, wherein, in the active mode of the form converter, the outer faces of the mold are directly clamped to change a vertically split form of the mold into a horizontally split form.

5. A molding and transporting apparatus comprising:

a molding section for using shutterings to define a molding space between a front die and a rear die, horizontally arranged opposite each other, that have vertically formed pattern faces, for, after sand has been vertically blown into the molding space from above, driving the front and rear dies and compacting the sand to produce a mold, and for extruding the mold horizontally;

a match plate insertion/removal mechanism for, before sand is blown into the molding space, inserting a match plate, in which a pattern face is vertically formed, into the middle point in the molding space, as needed;

a pouring port formation mechanism that is driven, as needed, to form a pouring port in the mold; and a form converter for selectively rendering an active operation for vertically laminating only the mold segments of the mold that are obtained by the match plate and are extruded from the molding section and for changing the form of the mold, and a non-active operation for transporting, to a pouring line, the mold extruded by the molding section, without changing the form of the mold.

6. A molding and transporting apparatus according to claim 5, wherein the form converter includes:

a rotation device, for rotating a front mold and a rear mold so that the rear mold and the front mold are positioned in the named order by the rotation device.

7. A molding and transporting apparatus according to claim 5, wherein the external faces of the mold are gripped directly, so that the form converter in the active state converts the vertical split form of the mold into the horizontal split form.

8. A molding and transporting apparatus comprising:

a molding section for using shutterings to define a molding space between a front die and a rear die, horizontally arranged opposite each other, that have vertically formed pattern faces, for, after sand has been vertically blown into the molding space from above, driving the front and rear dies and compacting the sand to produce a mold, and for extruding the mold horizontally;

a dividing mechanism, which is to be activated before sand is blown into the molding space and which, in the molding space, vertically divides the mold at an intermediate position to obtain front and rear mold segments;

a pouring port formation mechanism, for forming a pouring port in the mold; and a form converter, for vertically laminating only the front and rear mold segments extruded by the molding section to provide a mold assembly having a horizontally split form and for transporting the mold assembly to a pouring line.

* * * * *